US011408124B2

(12) United States Patent
Yoshioka et al.

(10) Patent No.: US 11,408,124 B2
(45) Date of Patent: Aug. 9, 2022

(54) PROCESSING APPARATUS, SHEET MANUFACTURING APPARATUS, PROCESSING METHOD, AND SHEET MANUFACTURING METHOD

(71) Applicant: Seiko Epson Corporation, Tokyo (JP)

(72) Inventors: Satomi Yoshioka, Shiojiri (JP); Shunichi Seki, Suwa (JP)

(73) Assignee: Seiko Epson Corporation

( * ) Notice: Subject to any disclaimer, the term of this patent is extended or adjusted under 35 U.S.C. 154(b) by 481 days.

(21) Appl. No.: 16/233,215

(22) Filed: Dec. 27, 2018

(65) Prior Publication Data

US 2019/0203415 A1 Jul. 4, 2019

(30) Foreign Application Priority Data

Dec. 28, 2017 (JP) ..... JP2017-254973
Feb. 26, 2018 (JP) ..... JP2018-032223

(51) Int. Cl.

| | |
|---|---|
| ***D21C 5/02*** | (2006.01) |
| ***D21H 11/14*** | (2006.01) |
| ***D21B 1/08*** | (2006.01) |
| ***D21F 9/00*** | (2006.01) |

(52) U.S. Cl.

CPC ..... *D21C 5/027* (2013.01); *D21B 1/08* (2013.01); *D21C 5/02* (2013.01); *D21F 9/00* (2013.01); *D21H 11/14* (2013.01)

(58) Field of Classification Search

CPC ..... D21C 5/025; D21C 5/027; D21C 5/02
See application file for complete search history.

(56) References Cited

U.S. PATENT DOCUMENTS

| | | | | |
|---|---|---|---|---|
| 4,076,578 | A * | 2/1978 | Puddington | D21C 5/025 162/5 |
| 4,290,988 | A | 9/1981 | Nopper et al. | |
| 4,382,758 | A | 5/1983 | Nopper et al. | |
| 5,151,155 | A * | 9/1992 | Cody | D21C 5/027 162/5 |
| 8,043,473 | B2 * | 10/2011 | Yuzawa | D21C 5/025 162/4 |

(Continued)

FOREIGN PATENT DOCUMENTS

| | | | |
|---|---|---|---|
| JP | S55-090659 | A | 7/1980 |
| JP | H03-076885 | A | 4/1991 |

(Continued)

*Primary Examiner* — Anthony Calandra
(74) *Attorney, Agent, or Firm* — Harness, Dickey & Pierce, P.L.C.

(57) ABSTRACT

A processing apparatus includes a powder material supply portion that supplies a powder material containing a first particle group consisting of a plurality of first particles, and a second particle group consisting of a plurality of second particles and having an average particle diameter larger than that of the first particle group, to a fiber-containing material containing a fiber during or after defibrating, and a powder material removing portion that removes at least a portion of the powder material from the fiber-containing material supplied with the powder material. It is preferable that the processing apparatus include a defibrating portion that defibrates the fiber-containing material on an upstream side of the powder material supply portion.

4 Claims, 11 Drawing Sheets

(56) References Cited

U.S. PATENT DOCUMENTS

| | | | | |
|---|---|---|---|---|
| 2012/0012031 | A1* | 1/2012 | Husband | D21H 19/38<br>106/204.3 |
| 2014/0290884 | A1* | 10/2014 | Yamagami | D21G 9/0018<br>162/158 |
| 2015/0204015 | A1 | 7/2015 | Gomi et al. | |
| 2016/0193754 | A1 | 7/2016 | Gomi et al. | |
| 2017/0203478 | A1 | 7/2017 | Gomi et al. | |

FOREIGN PATENT DOCUMENTS

| | | | |
|---|---|---|---|
| JP | 2000-284657 | A | 10/2000 |
| JP | 2016-186146 | A | 10/2016 |

* cited by examiner

PROCESSING APPARATUS, SHEET MANUFACTURING APPARATUS, PROCESSING METHOD, AND SHEET MANUFACTURING METHOD

BACKGROUND

1. Technical Field

The present invention relates to a processing apparatus, a sheet manufacturing apparatus, a processing method, and a sheet manufacturing method.

2. Related Art

In the related years, as environmental awareness rises, it is required not only to reduce the amount of paper (recording medium) used in a workplace but also to recycle the paper on the floor in the office.

As a method for recycling the recording medium, for example, there is known a method of removing a recording layer formed by ink, toner or the like by ejecting a blast material onto the recording layer (printed portion) of a used recording medium which is made of a sheet of paper and printed (for example, refer to JP-A-2000-284657). The recording medium from which the recording layer is removed becomes a usable medium again.

However, with the above method, there was a problem that it is impossible to sufficiently remove a foreign material (foreign material derived from constituent material of recording layer to be removed). In addition, even if a processing time is increased for the purpose of improving a removal rate of foreign material, there is a problem that the removal rate of foreign material can not be sufficiently improved and a processing efficiency is also lowered.

SUMMARY

An advantage of some aspects of the invention is to provide a processing apparatus, a sheet manufacturing apparatus, a processing method, and a sheet manufacturing method capable of efficiently removing a foreign material in a case where the foreign material is contained in a fiber-containing material.

Such an advantage is achieved by the following invention.

According to an aspect of the invention, there is provided a processing apparatus including a powder material supply portion that supplies a powder material containing a first particle group consisting of a plurality of first particles, and a second particle group consisting of a plurality of second particles and having an average particle diameter larger than that of the first particle group, to a fiber-containing material containing a fiber during or after defibrating; and a powder material removing portion that removes at least a portion of the powder material from the fiber-containing material supplied with the powder material.

Accordingly, it is possible to provide the processing apparatus capable of efficiently removing the foreign material in a case where the foreign material is contained in the fiber-containing material.

It is preferable that the apparatus further include a defibrating portion that defibrates the fiber-containing material on an upstream side of the powder material supply portion.

Accordingly, it is possible to suitably perform deinking processing using a raw material which is not defibrated (for example, sheet-shaped raw material) even without preparing the defibrated material which is previously defibrated.

In the apparatus, it is preferable that an average particle diameter of the second particle group be 2 times or more and 10,000 times or less an average particle diameter of the first particle group.

Accordingly, a synergistic effect due to containing the first particle group and the second particle group is exhibited more remarkably, and in a case where the foreign material is contained in the fiber-containing material, the removal efficiency of the foreign material can be made more excellent.

In the apparatus, it is preferable that an average particle diameter of the first particle group be 0.01 μm or more and 10 μm or less, and an average particle diameter of the second particle group be 5 μm or more and 1500 μm or less.

Accordingly, the removal efficiency of the foreign material adhered to an outer surface of the fiber-containing material in an exposed state can be made more excellent, and the foreign material intruding a minute space such as a gap between the fibers forming the fiber-containing material can be more efficiently removed, and as a result, the removal efficiency of the foreign material as a whole of the powder material can be made more excellent.

In the apparatus, it is preferable that the first particle and the second particle have different densities from each other.

Accordingly, the synergistic effect due to containing the first particle group and the second particle group is exhibited more remarkably.

In the apparatus, it is preferable that a density of the first particle be greater than a density of the second particle.

Accordingly, in the deinking processing, the kinetic energy of the first particles (particles having a relatively small particle diameter) can be sufficiently increased, the deinking processing with the first particles (in particular, removal of foreign material intruding into a minute space such as a gap between fibers forming fiber-containing material) can be efficiently proceeded, and the kinetic energy of the second particles (particles having a relatively large particle diameter) can be more reliably prevented from being excessively increased. Accordingly, the fibers forming the fiber-containing material can be more effectively prevented from being damaged (excessively shortening fiber length).

In the apparatus, it is preferable that a removal rate of the powder material in the powder material removing portion be 40% or more.

Accordingly, the quality of the fiber-containing material after the deinking processing and the sheet manufactured using the fiber-containing material can be made more excellent.

According to another aspect of the invention, there is provided a sheet manufacturing apparatus includes the processing apparatus of the aspect.

Accordingly, it is possible to efficiently remove the foreign material contained in the fiber-containing material and to manufacture the sheet from the material from which the foreign material is removed.

According to still another aspect of the invention, there is provided a processing method including supplying a powder material containing a first particle group consisting of a plurality of first particles, and a second particle group consisting of a plurality of second particles and having an average particle diameter larger than that of the first particle group, to a fiber-containing material containing a fiber during or after defibrating; agitating the powder material and the fiber-containing material in a state where the powder material and the fiber-containing material are mixed; and removing at least a portion of the powder material from the fiber-containing material supplied with the powder material.

Accordingly, it is possible to provide the processing method capable of efficiently removing the foreign material in a case where the foreign material is contained in the fiber-containing material.

According to still another aspect of the invention, there is provided a sheet manufacturing method including supplying a powder material containing a first particle group consisting of a plurality of first particles, and a second particle group consisting of a plurality of second particles and having an average particle diameter larger than that of the first particle group, to a fiber-containing material containing a fiber during or after defibrating; agitating the powder material and the fiber-containing material in a state where the powder material and the fiber-containing material are mixed; and removing at least a portion of the powder material from the fiber-containing material supplied with the powder material, in which a sheet is manufactured from the fiber-containing material from which the powder material is removed.

Accordingly, it is possible to efficiently remove the foreign material contained in the fiber-containing material and to manufacture the sheet from the material from which the foreign material is removed.

According to an application example of the invention, there is provided a processing apparatus including a powder material supply portion that supplies a powder material containing a first particle and a second particle having a different composition from that of the first particle, to the fiber-containing material containing a fiber during or after defibrating; and a powder material removing portion that removes at least a portion of the powder material from the fiber-containing material supplied with the powder material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described in detail with reference to the accompanying drawings.

First Embodiment

Figure 1:
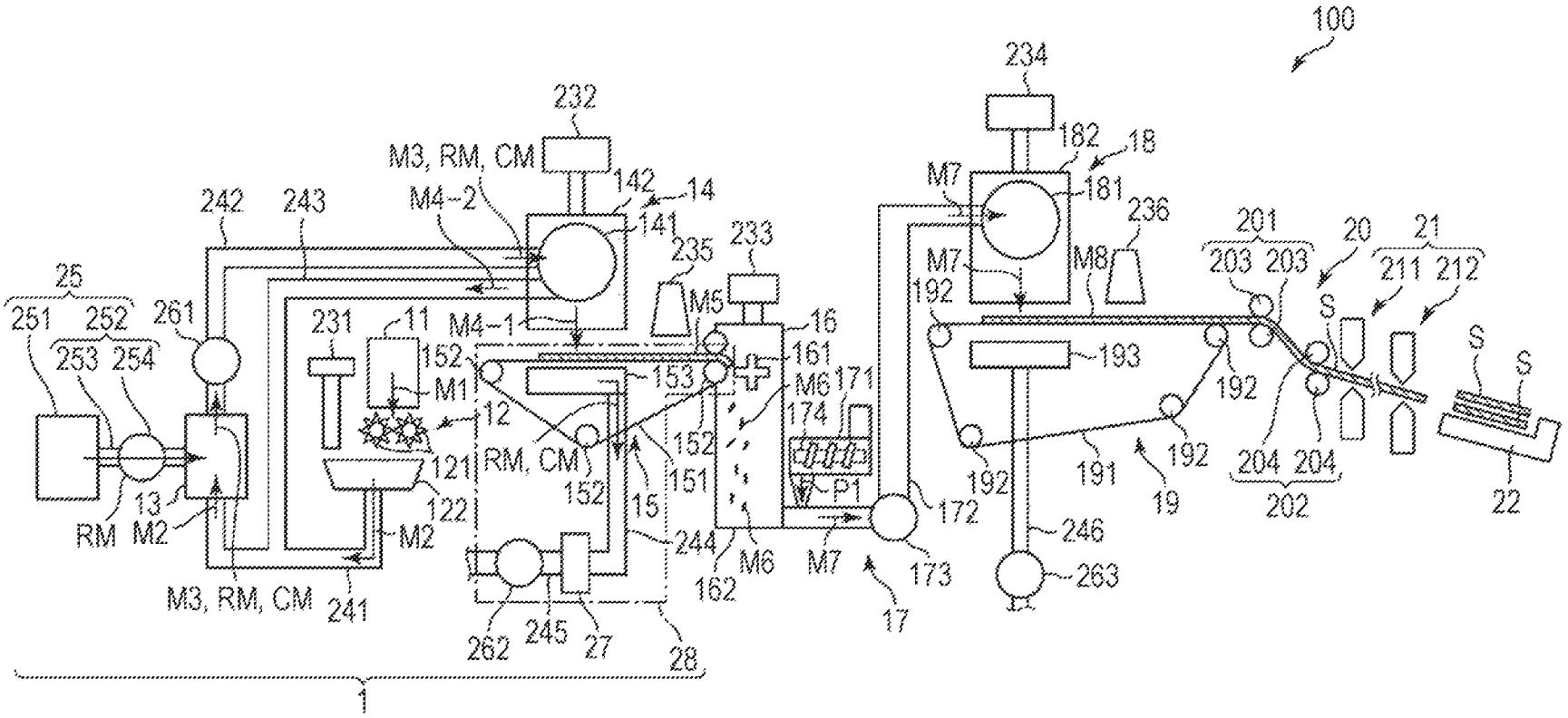
FIG. 1 is a schematic side view showing a first embodiment of a sheet manufacturing apparatus (including processing apparatus of the invention) of the invention.
Figure 2:
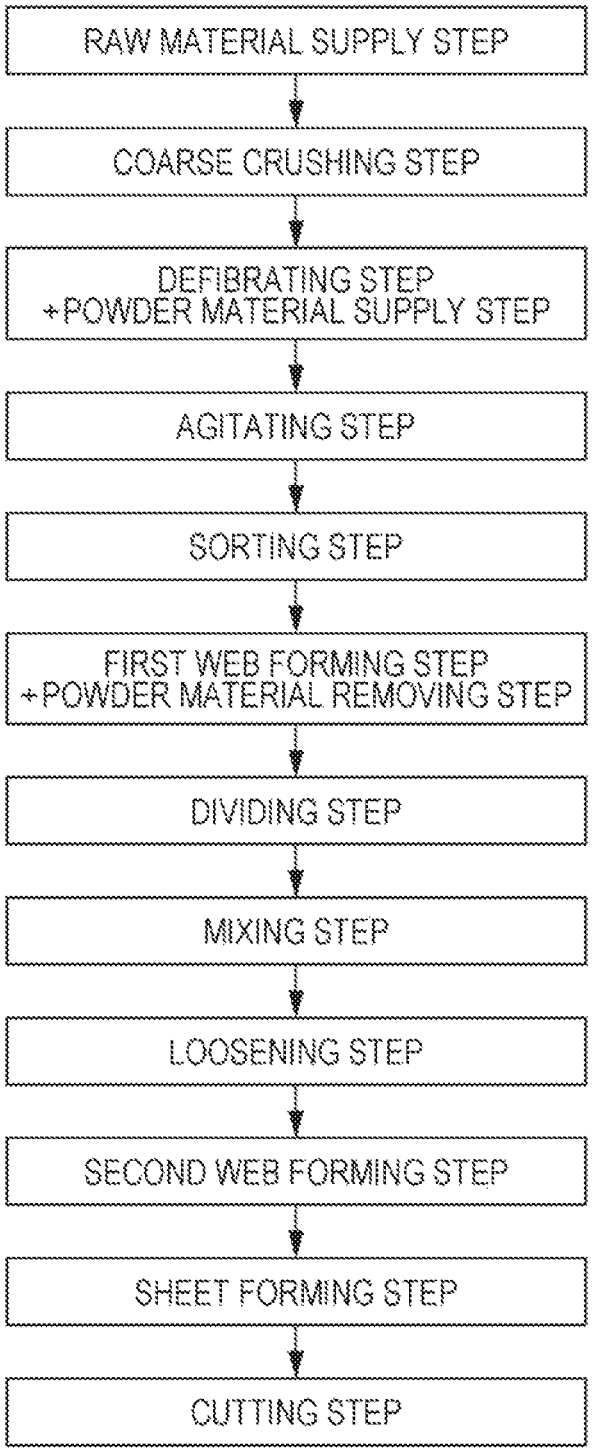
FIG. 2 is a flow chart sequentially showing steps performed by the sheet manufacturing apparatus shown in FIG. 1.
Figure 3:
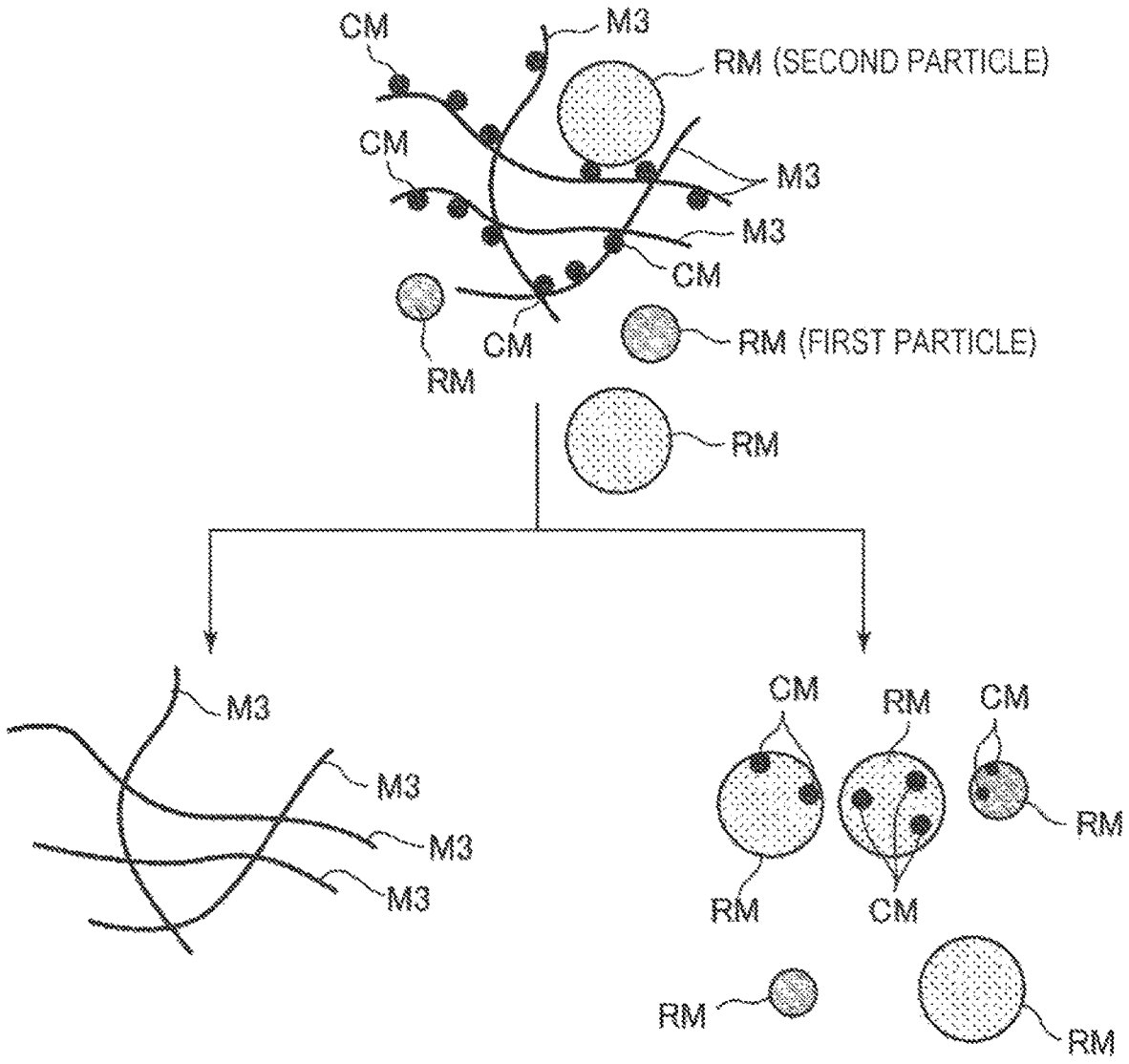
FIG. 3 is an image diagram showing a state where a powder material (deinking agent) is mixed with a fiber-containing material in the sheet manufacturing apparatus shown in FIG. 1, and a foreign material is adsorbed by the powder material and separated.
Figure 4:
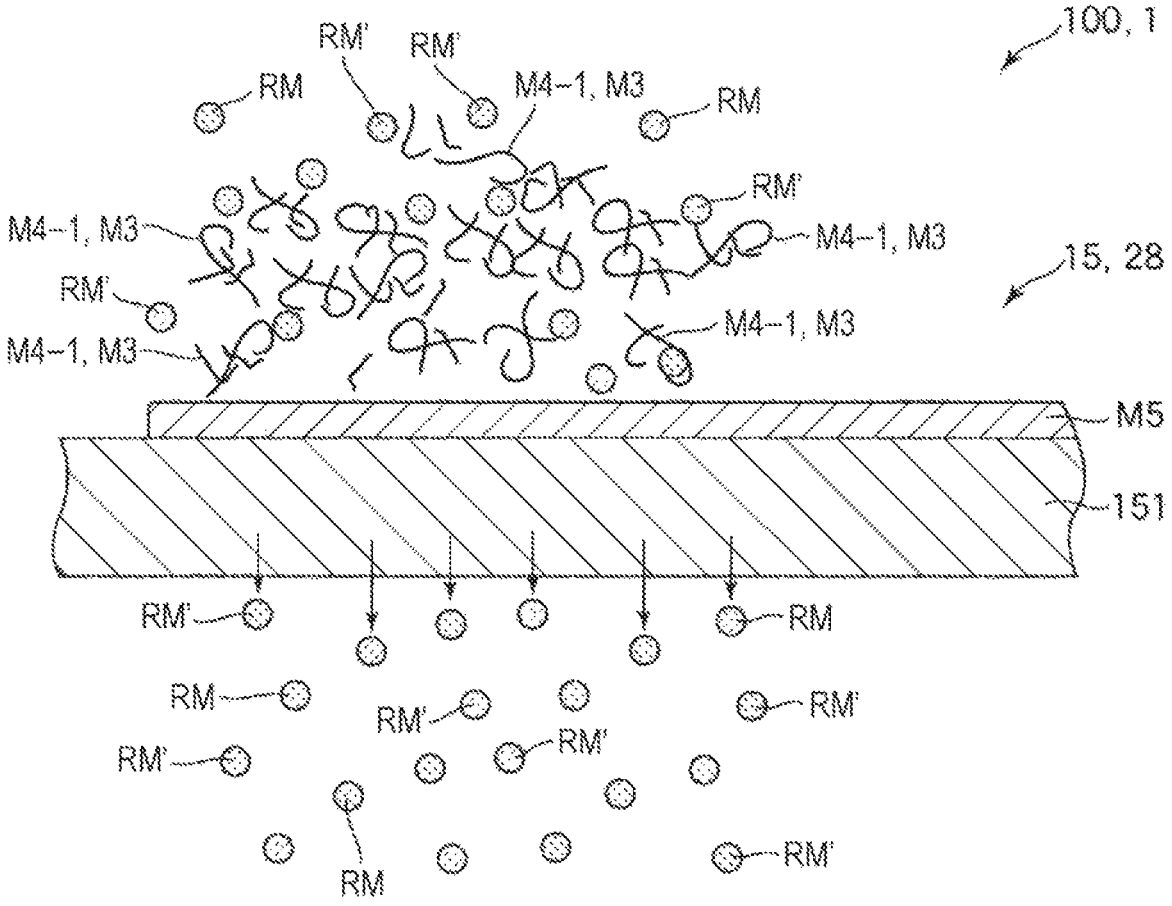
FIG. 4 is a schematic side view showing a state where the mixed powder material (deinking agent) and the fiber-containing material are sieved and a web from which the powder material is removed is accumulated on a mesh belt in the sheet manufacturing apparatus shown in FIG. 1.

FIG. 1 is a schematic side view showing a first embodiment of a sheet manufacturing apparatus (including processing apparatus of the invention) of the invention. FIG. 2 is a flow chart sequentially showing steps performed by the sheet manufacturing apparatus shown in FIG. 1. FIG. 3 is an image diagram showing a state where a powder material (deinking agent) is mixed with a fiber-containing material in the sheet manufacturing apparatus shown in FIG. 1, and a foreign material is adsorbed by the powder material and separated. FIG. 4 is a schematic side view showing a state where the mixed powder material (deinking agent) and the fiber-containing material are sieved and a web from which the powder material is removed is accumulated on a mesh belt in the sheet manufacturing apparatus shown in FIG. 1. Hereinafter, for convenience of description, an upper side may be referred to as "upper" or "upward", a lower side may be referred to as "lower" or "downward", a left side may be referred to as "left" or "upstream side", and a right side in FIGS. 1 and 4 (the same applies to FIGS. 5, 7, and 9) may be referred to as "right" or "downstream side".

A processing apparatus 1 of the invention is provided with a powder material supply portion 25 that supplies a powder material RM containing a first particle group consisting of a plurality of first particles, and a second particle group consisting of a plurality of second particles and having an average particle diameter larger than that of the first particle group, to a fiber-containing material M3 containing a fiber during or after defibrating, and a powder material removing portion 28 that removes at least a portion of the powder material RM from the fiber-containing material M3 supplied with the powder material RM.

In addition, a processing method of the invention is provided with a powder material supply step of supplying a powder material RM containing a first particle group consisting of a plurality of first particles, and a second particle group consisting of a plurality of second particles and having an average particle diameter larger than that of the first particle group, to a fiber-containing material M3 containing a fiber during or after defibrating, an agitating step of agitating the powder material and the fiber-containing material in a state where the powder material RM and the fiber-containing material M3 are mixed, and a powder material removing step of removing at least a portion of the powder material RM from the fiber-containing material M3 supplied with the powder material RM. This method is performed by the processing apparatus 1.

According to the invention as described above, as described later, even in a case where a foreign material CM derived from a recording material such as ink or toner (for example, a colorant, a binder resin, a charge control agent, or the like) is contained in the fiber-containing material M3, the foreign material CM can be efficiently removed from the fiber-containing material M3 by the powder material (deinking agent) RM. That is, the foreign material CM can be removed (deinked) from the fiber-containing material M3 with a high removal rate in short time processing. In addition, thereafter, the foreign material CM can also be removed with the powder material RM by the powder material removing portion 28 (powder material removing step). In particular, it is possible to remove the foreign material CM in a dry manner without requiring a large amount of water or large equipment. Specifically, while the removal efficiency of foreign material CM adhered to an outer surface of the fiber-containing material M3 in an exposed state is excellent, it is possible to efficiently remove the foreign material CM entering a minute space such as a gap between the fibers forming the fiber-containing material M3.

In the invention, the average particle diameter refers to an average particle diameter based on the number. The average particle diameter of the powder refers to the number average value of the particle long diameter (diameter in the length direction of the particle) measured using a dry type particle size distribution meter and calculated by analysis using a static image analyzer (static image analysis apparatus: Morphologi G3: manufactured by Malvern).

In addition, in the invention, "deinking" refers to removing (separating) foreign material derived from a recording material such as ink or toner. In addition, in the invention, "processing" refers to deinking processing on a paper material including a used paper. In the deinking processing in the related art, processing of dispersing the used paper in water, releasing the coloring agent mechanically and chemically (surfactants, alkaline chemicals, or the like), and removing the foreign material by a floating method, a screen washing method or the like is normally used. In the invention, deinking can be performed without requiring to soak the used paper in water. The deinking can be said to be a dry deinking technique.

The sheet manufacturing apparatus 100 of the invention is provided with the processing apparatus 1.

In addition, a sheet manufacturing method of the invention is provided with a powder material supply step of supplying a powder material RM containing a first particle group consisting of a plurality of first particles, and a second particle group consisting of a plurality of second particles and having an average particle diameter larger than that of the first particle group, to a fiber-containing material M3 containing a fiber during or after defibrating, an agitating step of agitating the powder material and the fiber-containing material in a state where the powder material RM and the fiber-containing material M3 are mixed, and a powder material removing step of removing at least a portion of the powder material RM from the fiber-containing material M3 supplied with the powder material RM, and a sheet S is manufactured from the fiber-containing material M3 from which the powder material RM is removed. This method is performed by the sheet manufacturing apparatus 100.

According to the invention as described above, the sheet S is further manufactured (reproduced) from the material from which the foreign material CM derived from the recording material such as ink, toner or the like (for example, a colorant, a binder resin, a charge control agent, or the like) is removed while enjoying the advantages of the above-described processing apparatus 1 (processing method). In particular, it is possible to manufacture the sheet S with high whiteness in a dry manner without requiring a large amount of water or large equipment.

The sheet manufacturing apparatus 100 shown in FIG. 1 is provided with a raw material supply portion 11, a coarse crushing portion 12, a defibrating portion 13, a powder material supply portion 25, a sorting portion 14, a first web forming portion 15, a subdividing portion 16, a mixing portion 17, a loosening portion 18, a second web forming portion 19, a sheet forming portion 20, a cutting portion 21, and a stock portion 22. In addition, the sheet manufacturing apparatus 100 is provided with a humidifying portion 231, a humidifying portion 232, a humidifying portion 233, and a humidifying portion 234. The operation of each part of the sheet manufacturing apparatus 100 is controlled by a control unit (not shown).

In addition, the sheet manufacturing apparatus 100 is provided with the processing apparatus 1. In the embodiment, the processing apparatus 1 is configured to include the raw material supply portion 11, the coarse crushing portion 12, the defibrating portion 13, the powder material supply portion 25, the sorting portion 14, and the first web forming portion 15.

As shown in FIG. 2, in the embodiment, the method for manufacturing a sheet includes a raw material supply step, a coarse crushing step, a defibrating step, a sorting step, a first web forming step, a dividing step, a mixing step, a loosening step, a second web forming step, a sheet forming step, and a cutting step. In addition, the powder material supply step is performed with the defibrating step, and the powder material removing step is performed with the first web formation step. In addition, an agitation step is provided between the powder material supply step and the sorting step. The sheet manufacturing apparatus 100 can sequentially perform these steps. In addition, among these steps, the steps performed by the processing apparatus 1 are the raw material supply step, the coarse crushing step, the defibrating step, the powder material supply step, the sorting step, the first web forming step, and the powder material removing step.

Hereinafter, the configuration of each part provided in the sheet manufacturing apparatus 100 will be described.

The raw material supply portion 11 is a portion that performs the raw material supply step (refer to FIG. 2) of supplying the raw material M1 to the coarse crushing portion 12. The raw material M1 is, for example, a sheet-like material formed of a fiber-containing material containing a fiber (cellulose fiber). In addition, in the embodiment, although the raw material M1 is the used paper, that is, a used sheet, it is not limited thereto, and it may be an unused sheet. The cellulose fiber may be any one as long as it is fibrous mainly formed of cellulose as a compound. The cellulose fiber is not limited as long as it is fibrous mainly formed of cellulose (narrowly defined cellulose) as a compound, and may contain hemicellulose and lignin in addition to cellulose and derivatives thereof.

The coarse crushing portion 12 is a portion that performs the coarse crushing step (refer to FIG. 2) of crushing the raw material M1 supplied from the raw material supply portion 11 in the air (in air). The coarse crushing portion 12 has a pair of coarse crushing blades 121 and a chute (hopper) 122.

By rotating in a direction opposite to each other, the pair of coarse crushing blades 121 can coarsely crush, that is, cut the raw material M1 therebetween into coarse crushed pieces M2. The shape and size of the coarse crushed piece M2 are preferably suitable for defibrating processing in the defibrating portion 13. For example, it is preferably a small piece having a side length of 100 mm or less, more preferably a small piece of 10 mm or more and 70 mm or less.

The chute 122 is disposed below the pair of coarse crushing blades 121, and has a funnel shape, for example. As a result, the chute 122 can receive the coarse crushed piece M2 that is crushed and dropped by the coarse crushing blade 121.

In addition, above the chute 122, the humidifying portion 231 is disposed adjacent to the pair of coarse crushing blades 121. The humidifying portion 231 humidifies the coarse crushed piece M2 in the chute 122. The humidifying portion 231 has a filter (not shown) containing moisture, and is formed of a vaporization type (or warm air vaporization type) humidifier which supplies humidified air having increased humidity to the coarse crushed piece M2 by allowing air to pass through the filter. By supplying the humidified air to the coarse crushed piece M2, it is possible to inhibit the adhesion of the coarse crushed piece M2 to the chute 122 or the like due to static electricity.

The chute 122 is connected to the defibrating portion 13 via a pipe (flow path) 241. The coarse crushed piece M2 collected in the chute 122 passes through the pipe 241 and is transported to the defibrating portion 13.

The defibrating portion 13 is provided on the upstream side of the powder material supply portion 25 and is a portion that performs the defibrating step (refer to FIG. 2) of defibrating the coarse crushed piece M2 (fiber-containing material containing fiber) in the air, that is, in a dry manner. By the defibrating processing at the defibrating portion 13, the fiber-containing material M3 as a defibrated material can be generated from the coarse crushed piece M2. In this manner, since the processing apparatus 1 is provided with the defibrating portion 13, it is possible to suitably perform the deinking processing using the raw material M1 which is not defibrated (for example, sheet-shaped raw material M1) even without preparing the defibrated material which is previously defibrated (defibrated material defibrated from fiber-containing material). Here, "to defibrate" refers to unravel the coarse crushed piece M2 formed by binding a plurality of fibers to each fiber one by one. This unraveled material is the defibrated material (fiber-containing material) M3. The shape of the defibrated material M3 is a linear shape or a belt shape. In addition, the defibrated material M3 may exist in a state of being intertwined to form a lump, that is, in a state of forming a so-called "Dama".

In the embodiment, for example, the defibrating portion 13 is formed of an impeller mill having a rotor rotating at high speed and a liner positioned on an outer periphery of the rotor. The coarse crushed piece M2 flowing into the defibrating portion 13 is interposed between the rotor and the liner and is defibrated by a crushing and pulverizing defibrating action to be a fiber-containing material (defibrated material) M3.

In addition, the defibrating portion 13 can generate a flow of air (air flow) from the coarse crushing portion 12 to the sorting portion 14 by the rotation of the rotor. As a result, the coarse crushed piece M2 can be sucked from the pipe 241 to the defibrating portion 13. In addition, after the defibrating processing, the defibrated material M3 can be sent out to the sorting portion 14 via a pipe 242.

The powder material supply portion 25 is connected to the defibrating portion 13 having such a configuration. The powder material supply portion 25 is a portion for supplying the powder material RM containing the plurality of first particles and second particles having different average particle diameters from each other to the fiber-containing material (defibrated material) M3 during defibrating. Therefore, the powder material RM supplied from the powder material supply portion 25 to the defibrating portion 13 is mixed with the fiber-containing material (defibrated material) M3 during defibrating. That is, in the embodiment, in the defibrating portion 13, the powder material supply step of supplying the powder material RM to the fiber-containing material M3, and the agitating step of agitating the powder material and the fiber-containing material in a state where the powder material RM and the fiber-containing material M3 are mixed are performed with the defibrating step. In a case where a shearing force acts between the powder material RM and the fiber-containing material (defibrated material) M3 and the foreign material CM adheres to the fiber-containing material (defibrated material) M3, the foreign material CM efficiently is removed. The configuration of the powder material supply portion 25 and the powder material RM will be described in detail later.

In addition, the defibrating portion 13 is connected to the sorting portion 14 via the pipe (flow path) 242. The defibrated material M3 (fiber-containing material after defibrating) passes through the pipe 242 and is transported to the sorting portion 14.

In addition, a blower 261 is installed in the middle of the pipe 242. The blower 261 is an air flow generating device that generates an air flow toward the sorting portion 14. As a result, the delivery of the defibrated material M3 to the sorting portion 14 is promoted.

The sorting portion 14 performs the sorting step (refer to FIG. 2) of sorting the defibrated material M3 according to the length of the fiber. In the sorting portion 14, the defibrated material M3 is sorted into a first sorted object M4-1 and a second sorted object M4-2 larger than the first sorted object M4-1. The first sorted object M4-1 has a size suitable for the subsequent manufacture of the sheet S. The second sorted object M4-2 includes, for example, an insufficiently defibrated material, an excessively aggregated defibrated material, and the like.

The sorting portion 14 has a drum portion 141 and a housing portion 142 that houses the drum portion 141.

The drum portion 141 is formed of a cylindrical mesh body and is a sieve that rotates about the central axis. The defibrated material M3 flows into the drum portion 141. As the drum portion 141 rotates, the defibrated material M3' smaller than a mesh opening is sorted as a first sorted object M4-1, and the defibrated material M3' larger than the mesh opening is sorted as a second sorted object M4-2.

The first sorted object M4-1 falls from the drum portion 141.

On the other hand, the second sorted object M4-2 is sent out to a pipe (flow path) 243 connected to the drum portion 141. The pipe 243 is connected to the pipe 241 on the side (downstream side) opposite to the drum portion 141. The second sorted object M4-2 passed through the pipe 243 joins the coarse crushed piece M2 in the pipe 241 and flows into the defibrating portion 13 with the coarse crushed piece M2. As a result, the second sorted object M4-2 is returned to the defibrating portion 13 and is subjected to the defibrating processing with the coarse crushed piece M2.

In addition, the first sorted object M4-1 from the drum portion 141 falls while dispersing in the air and heads toward the first web forming portion (separation portion) 15 located below the drum portion 141. The first web forming portion 15 is a portion for performing the first web forming step (refer to FIG. 2) of forming a first web M5 from the first sorted object M4-1. The first web forming portion 15 has a mesh belt (separation belt) 151, three stretching rollers 152, and a suction portion (suction mechanism) 153.

The mesh belt 151 is an endless belt, and the first sorted object M4-1 is accumulated. The mesh belt 151 is wrapped around three stretching rollers 152. By rotationally driving the stretching roller 152, the first sorted object M4-1 on the mesh belt 151 is transported to the downstream side.

The first sorted object M4-1 is larger than the mesh opening of the mesh belt 151. As a result, the first sorted object M4-1 is restricted from passing through the mesh belt 151, and thus can be accumulated on the mesh belt 151. In addition, since the first sorted object M4-1 is accumulated on the mesh belt 151 while being transported to the downstream side with the mesh belt 151, the first sorted object M4-1 is formed as a layered first web M5.

In addition, in the first sorted object M4-1, the powder material RM described later in detail coexists.

The powder material RM is smaller than the mesh opening of the mesh belt 151. As a result, the powder material RM passes through the mesh belt 151 and fall further downward.

The first web forming portion 15 constitutes a portion of the powder material removing portion 28. In addition to the first web forming portion 15, the powder material removing portion 28 is provided with a collecting portion 27, a pipe 244, a pipe 245, and a blower 262. The powder material removing portion 28 will be described in detail later.

The suction portion 153 can suck air from below the mesh belt 151. As a result, the powder material RM passing through the mesh belt 151 can be sucked with the air.

In addition, the suction portion 153 is connected to the collecting portion 27 via the pipe (flow path) 244. The powder material RM sucked by the suction portion 153 is collected by the collecting portion 27.

A pipe (flow path) 245 is further connected to the collecting portion 27. In addition, a blower 262 is installed in the middle of the pipe 245. By the operation of the blower 262, suction force can be generated by the suction portion 153. As a result, formation of the first web M5 on the mesh belt 151 is promoted. The first web M5 is obtained by removing the powder material RM. In addition, the powder material RM reach the collecting portion 27 after passing through the pipe 244 by operation of the blower 262.

The housing portion 142 is connected to the humidifying portion 232. The humidifying portion 232 is formed of a vaporization type humidifier similar to the humidifying portion 231. As a result, humidified air is supplied into the housing portion 142. By this humidified air, it is possible to humidify the first sorted object M4-1, and thus it is possible to inhibit the first sorted object M4-1 from adhering to an inner wall of the housing portion 142 due to electrostatic force.

On the downstream side of the sorting portion 14, the humidifying portion 235 is disposed. The humidifying portion 235 is formed of an ultrasonic humidifier for spraying water. As a result, moisture can be supplied to the first web M5, and thus the moisture content of the first web M5 is adjusted. By this adjustment, the first web M5 can be inhibited from adsorbing to the mesh belt 151 due to electrostatic force. As a result, the first web M5 is easily separated from the mesh belt 151 at a position where the mesh belt 151 is folded back by the stretching roller 152.

On the downstream side of the humidifying portion 235, the subdividing portion 16 is disposed. The subdividing portion 16 is a portion that performs the dividing step (refer to FIG. 2) of dividing the first web M5 separated from the mesh belt 151. The subdividing portion 16 has a propeller 161 rotatably supported and a housing portion 162 housing the propeller 161. By winding the first web M5 around the rotating propeller 161, it is possible to divide the first web M5. The divided first web M5 becomes a subdivided body M6. In addition, the subdivided body M6 descends within the housing portion 162.

The housing portion 162 is connected to the humidifying portion 233. The humidifying portion 233 is formed of a vaporization type humidifier similar to the humidifying portion 231. As a result, humidified air is supplied into the housing portion 162. By this humidified air, it is also possible to prevent the subdivided body M6 from adhering to the inner wall of the propeller 161 and the housing portion 162 due to electrostatic force.

On the downstream side of the subdividing portion 16, the mixing portion 17 is disposed. The mixing portion 17 is a portion that performs the mixing step (refer to FIG. 2) of mixing the subdivided body M6 and a binder P1. The mixing portion 17 includes a binder supply portion 171, a pipe (flow path) 172, and a blower 173.

The pipe 172 connects the housing portion 162 of the subdividing portion 16 and a housing portion 182 of the loosening portion 18, and is a flow path through which a mixture M7 of the subdivided body M6 and the binder P1 passes.

The binder supply portion 171 is connected to the middle of the pipe 172. The binder supply portion 171 has a screw feeder 174. By rotationally driving the screw feeder 174, it is possible to supply the binder P1 as a powder to the pipe 172. The binder P1 supplied to the pipe 172 is mixed with the subdivided body M6 to be the mixture M7.

The binder P1 bonds the fibers to each other in a later step. For example, a thermoplastic resin, a curable resin, or the like can be used, and a thermoplastic resin is preferably used. Examples of thermoplastic resin include polyolefin such as AS resin, ABS resin, polyethylene, polypropylene, ethylene-vinyl acetate copolymer (EVA), acrylic resins such as modified polyolefins, polymethyl methacrylate, polyester such as polyvinyl chloride, polystyrene, polyethylene terephthalate, polybutylene terephthalate, polyamides (nylon) such as nylon 6, nylon 46, nylon 66, nylon 610, nylon 612, nylon 11, nylon 12, nylon 6-12, nylon 6-66, liquid crystal polymers such as polyphenylene ether, polyacetal, polyether, polyphenylene oxide, polyether ether ketone, polycarbonate, polyphenylene sulfide, thermoplastic polyimide, polyetherimide, aromatic polyester, various thermoplastic elastomers such as styrene type, polyolefin type, polyvinyl chloride type, polyurethane type, polyester type, polyamide type, polybutadiene type, trans polyisoprene type, fluoro rubber type, chlorinated polyethylene type, and the like. One type or two or more types selected from these can be used in combination. Preferably, as the thermoplastic resin, a polyester or a resin containing polyester is used.

As a material supplied from the binder supply portion 171, for example, a coloring agent for coloring the fiber, an aggregation inhibitor for inhibiting aggregation of the fiber or aggregation of the binder P1, a flame retardant for making the fiber less susceptible to burning, and the like may be included, in addition to the binder P1.

In addition, the blower 173 is installed on the downstream side of the binder supply portion 171 in the pipe 172. The blower 173 can generate the air flow towards the loosening portion 18. With this air flow, the subdivided body M6 and the binder P1 can be agitated in the pipe 172. As a result, the mixture M7 can flow into the loosening portion 18 in a state where the subdivided body M6 and the binder P1 are uniformly dispersed. In addition, the subdivided body M6 in the mixture M7 is loosened in the process of passing through the inside of the pipe 172, and becomes finer fibrous.

The loosening portion 18 is a portion for performing the loosening step (refer to FIG. 2) of loosening the mutually entangled fibers in the mixture M7. The loosening portion 18 has a drum portion 181 and a housing portion 182 for housing the drum portion 181.

The drum portion 181 is formed of a mesh body having a cylindrical shape and is a sieve rotating around the central axis. The mixture M7 flows into the drum portion 181. As the drum portion 181 rotates, fibers or the like smaller than the mesh opening of the mixture M7 can pass through the drum portion 181. At that time, the mixture M7 is loosened.

In addition, the mixture M7 loosened by the drum portion 181 falls while dispersing in the air and heads toward the second web forming portion 19 located below the drum portion 181. The second web forming portion 19 is a portion for performing the second web forming step (refer to FIG. 2) of forming a second web M8 from the mixture M7. The second web forming portion 19 includes a mesh belt (separation belt) 191, a stretching roller 192, and a suction portion (suction mechanism) 193.

The mesh belt 191 is an endless belt, and the mixture M7 is accumulated. The mesh belt 191 is wrapped around four stretching rollers 192. By rotationally driving the stretching roller 192, the mixture M7 on the mesh belt 191 is transported to the downstream side.

In addition, most of the mixture M7 on the mesh belt 191 is larger than the mesh opening of the mesh belt 191. As a result, the mixture M7 is restricted from passing through the mesh belt 191, and thus can be accumulated on the mesh belt 191. In addition, since the mixture M7 is accumulated on the mesh belt 191 while being transported to the downstream side with the mesh belt 191, the mixture M7 is formed as the layered second web M8.

The suction portion 193 can suck air from below the mesh belt 191. As a result, the mixture M7 can be sucked onto the mesh belt 191, and thus the accumulation of the mixture M7 is promoted on the mesh belt 191.

A pipe (flow path) 246 is connected to the suction portion 193. In addition, a blower 263 is installed in the middle of the pipe 246. By the operation of the blower 263, suction force can be generated by the suction portion 193.

The housing portion 182 is connected to the humidifying portion 234. The humidifying portion 234 is formed of a vaporization type humidifier similar to the humidifying portion 231. As a result, humidified air is supplied into the housing portion 182. By this humidified air, it is possible to humidify the interior of the housing portion 182, and thus it is possible to inhibit the mixture M7 from adhering to the inner wall of the housing portion 182 due to electrostatic force.

On the downstream side of the loosening portion 18, the humidifying portion 236 is disposed. The humidifying portion 236 is formed of an ultrasonic humidifier similar to the humidifying portion 235. As a result, moisture can be supplied to the second web M8, and thus the moisture content of the second web M8 is adjusted. By this adjustment, the second web M8 can be inhibited from adsorbing onto the mesh belt 191 due to electrostatic force. As a result, the second web M8 is easily separated from the mesh belt 191 at a position where the mesh belt 191 is folded back by the stretching roller 192.

On the downstream side of the second web forming portion 19, the sheet forming portion 20 is disposed. The sheet forming portion 20 is a portion for performing the sheet forming step (refer to FIG. 2) of forming the sheet S from the second web M8. The sheet forming portion 20 includes a pressurizing portion 201 and a heating portion 202.

The pressurizing portion 201 has a pair of calender rollers 203, and can apply pressure without heating the second web M8 therebetween. As a result, the density of the second web M8 is increased. The second web M8 is transported toward the heating portion 202. One of the pair of calender rollers 203 is a main driving roller driven by the operation of a motor (not shown), and the other is a driven roller.

The heating portion 202 has a pair of heating rollers 204, and can apply pressure while heating the second web M8 therebetween. With this heating and pressurization, in the second web M8, the binder P1 is melted, and the fibers are bonded to each other via the molten binder P1. As a result, the sheet S is formed. The sheet S is transported toward the cutting portion 21. One of the pair of heating rollers 204 is a main driving roller driven by operation of a motor (not shown), and the other is a driven roller.

On the downstream side of the sheet forming portion 20, the cutting portion 21 is disposed. The cutting portion 21 is a portion that performs the cutting step (refer to FIG. 2) of cutting the sheet S. The cutting portion 21 includes a first cutter 211 and a second cutter 212.

The first cutter 211 cuts the sheet S in a direction intersecting with the transport direction of the sheet S.

The second cutter 212 cuts the sheet S in a direction parallel to the transport direction of the sheet S on the downstream side of the first cutter 211.

By cutting the first cutter 211 and the second cutter 212 as described above, a sheet S having a desired size can be obtained. The sheet S is further transported to the downstream side and accumulated in the stock portion 22.

Incidentally, as described above, the powder material supply portion 25 is connected to the defibrating portion 13 (refer to FIG. 1). The powder material supply portion 25 is a portion that performs the powder material supply step (refer to FIG. 2) of supplying the powder material RM to the defibrated material M3 during defibrating in the defibrating portion 13. In the embodiment, with respect to the defibrated material M3, the powder material supply step is also performed while performing the defibrating step in the air.

In FIG. 1, although the powder material supply portion 25 is shown connected to the center of the defibrating portion 13, the powder material supply portion 25 may supply the powder material RM to the defibrating portion 13, so that it is not necessarily limited to this configuration. For example, the powder material supply portion 25 may be configured to be connected to the pipe 241 on the upstream side of the defibrating portion 13, and to transport the powder material RM to the defibrating portion 13 with the coarse crushed piece M2 transported from the chute 122.

In the embodiment, the raw material M1 is a used paper that is printed and used. Therefore, as shown in FIG. 3, the defibrated material M3 contains the foreign material CM (for example, a colorant, a binder resin, a charge control agent, or the like) derived from the recording material such as ink or toner.

The powder material RM supplied from the powder material supply portion 25 to the defibrating portion 13 has a function of adsorbing the foreign material CM contained in the defibrated material M3 (fiber).

The powder material RM supplied from the powder material supply portion 25 to the defibrating portion 13 is mixed with the fiber-containing material (defibrated material) M3 during defibrating, so that a shearing force acts between the powder material RM and the fiber-containing material (defibrated material) M3. As a result, as shown in FIG. 3, the adsorption function included in the powder material RM is effectively exhibited, and the foreign material CM moves to the powder material RM to be efficiently removed (separated) from the defibrated material M3.

The powder material supply portion 25 includes a storage portion 251. The storage portion 251 is a tank that stores the powder material RM. In a case where the powder material RM is empty, the storage portion 251 exchanges the powder material RM with a new one in which the powder material RM is sufficiently stored, or adds (replenishes) the powder material RM.

The powder material supply portion 25 is connected (or installed) to the defibrating portion 13 between the powder material supply portion 25 and the storage portion 251, and includes an ejecting portion 252 for ejecting the powder material RM toward the defibrated material M3 in the defibrating portion 13. The ejecting portion 252 is formed of a pipe 253 and a blower 254. The powder material supply portion 25 may be installed inside the defibrating portion 13 or may be installed integrally with the defibrating portion 13.

The pipe 253 connects the storage portion 251 and the defibrating portion 13. The powder material RM can pass through the pipe 253 from the storage portion 251 toward the defibrating portion 13.

The blower 254 is installed in the middle of the pipe 253 in the longitudinal direction. The blower 254 can generate an air flow towards the defibrating portion 13. As a result, the powder material RM passes through the inside of the pipe 253 and is ejected into the defibrating portion 13. Some of the ejected powder materials RM collide with the foreign material CM adhering to the defibrated material M3 and come into contact therewith. This powder material RM can adsorb the foreign material CM and transfer the foreign material CM from the defibrated material M3. As a result, it is possible to efficiently remove the foreign material CM from the defibrated material M3.

In addition, by the ejecting of the powder material RM, the defibrated material M3 is in contact with the powder material RM while being agitated. As a result, the contact between the foreign material CM adhering to the defibrated material M3 and the powder material RM is also promoted, and thus it is possible to sufficiently remove the foreign material CM from the defibrated material M3.

The supply amount of the powder material RM with respect to 100 parts by mass of the defibrated material M3 is not particularly limited, and it is preferably 10 parts by mass or more and 100,000 parts by mass or less, more preferably 30 parts by mass or more and 50,000 parts by mass or less, and still more preferably 100 parts by mass or more and 10,000 parts by mass or less.

As a result, the foreign material CM contained in the defibrated material M3 can be more efficiently removed while suppressing the usage amount of the powder material RM. In addition, separation and removal of the powder material RM (powder material RM') from the defibrated material M3 subjected to the deinking processing can be performed more easily and more reliably.

The velocity (ejection velocity) of the powder material RM ejected into the defibrating portion 13 is appropriately set, for example, depending on the constituent material and size of the powder material RM.

As shown in FIG. 1, the sheet manufacturing apparatus 100 (processing apparatus 1) is provided with the powder material removing portion 28. The powder material removing portion 28 is a portion for performing the powder material removing step (refer to FIG. 2) of removing the powder material RM from the defibrated material M3 supplied with the powder material RM with the foreign material CM. In the embodiment, the powder material removing step is also performed on the defibrated material M3 while performing the first web forming step.

In the configuration shown in FIG. 1, the powder material removing portion 28 is provided with the first web forming portion 15, the collecting portion 27, the pipe 244, the pipe 245, and the blower 262.

Above the first web forming portion 15, as described above, the defibrated material M3 is sorted into the first sorted object M4-1 and the second sorted object M4-2 by the sorting portion 14. As shown in FIG. 4, in the first sorted object M4-1, the powder material RM adsorbing the foreign material CM (hereinafter, this powder material RM may be referred to as "powder material RM'") coexists. The first sorted object M4-1 may contain the powder material RM not adsorbing the foreign material CM. The first sorted object M4-1 falls onto the mesh belt 151 of the first web forming portion 15 with the powder material (deinking agent) RM'.

The powder material removing portion 28 separates and removes the powder material RM by using the difference in size between the powder material RM and the defibrated material M3 (fiber). That is, the powder material removing portion 28 is provided with the mesh belt 151 (mesh body) having a mesh opening of a size that allows the powder material RM (powder material RM') to pass through and regulates the passage of the fiber of the first sorted object M4-1 (defibrated material M3).

As a result, as shown in FIG. 4, the first sorted object M4-1 accumulates on the mesh belt 151 and is formed as the first web M5. On the other hand, the powder material RM (powder material RM') passes through the mesh belt 151 by the suction force of the suction portion 153, and thereafter passes through the suction portion 153 and the pipe 244 in turn, and is collected by the collecting portion 27. As a result, the powder material RM (powder material RM') is efficiently removed from the first web M5 (defibrated material M3). The first web M5 is transferred to the subsequent step and finally becomes the sheet S. The mesh opening of the mesh belt 151 is set to a value larger than the second particle of the powder material RM.

The powder material RM collected in the collecting portion 27 includes the powder material RM adsorbing the foreign material CM, that is, the powder material RM' and the powder material RM not adsorbing the foreign material CM.

In addition, in the powder material removing portion 28, the entire amount of the supplied powder material RM may be removed (separated), or a portion of the supplied powder material RM may be removed. That is, a portion of the supplied powder material RM (containing powder material RM') may remain in the defibrated material M3 after the deinking processing.

In this case, the removal rate of the powder material RM in the powder material removing portion 28 (ratio of mass of removed powder material RM to mass of supplied powder material RM) is preferably 40% or more, more preferably 50% or more, and further preferably 60% or more.

As a result, the quality of the defibrated material M3 after the deinking processing and the sheet S manufactured using the defibrated material M3 can be made more excellent.

In addition, the removal rate of the first particle group and the second particle group forming the powder material RM in the powder material removing portion 28 may be the same as or different from each other. Specifically, for example, the removal rate of the second particle group in the powder material removing portion 28 may be higher or lower than the removal rate of the first particle group in the powder material removing portion 28, and is preferably higher than the removal rate of the first particle group in the powder material removing portion 28.

In the embodiment, the powder material RM containing the first particle and the second particle is removed at once by the powder material removing portion 28, and the invention is not limited thereto. The first particle and the second particle of the powder material RM may be divided into a plurality of stages and removed. In this case, each removal may be performed by a method suitable for the particle diameter and composition of each of the first particle and the second particle. For example, the removal of the first particle having a small particle diameter may be performed by an electrostatic adsorption method or the like in a previous step or a subsequent step of the powder material removing portion 28. As a result, it is possible to further increase the removal rate of the first particle having a small particle diameter which is less susceptible to the suction force than the second particle.

As described above, in the sheet manufacturing apparatus 100 (processing apparatus 1), even in a case where the foreign material CM is contained in used paper as a raw material for recycling the sheet. The foreign material CM is removed by the powder material RM supplied from the powder material supply portion 25 and thereafter the foreign material CM can be removed with the powder material RM by the powder material removing portion 28. As a result, the sheet S to be manufactured is a high-quality sheet from which the foreign materials CM which can be impurities are removed during recycling.

Hereinafter, the powder material RM according to the invention will be described in detail.

Figure 11:
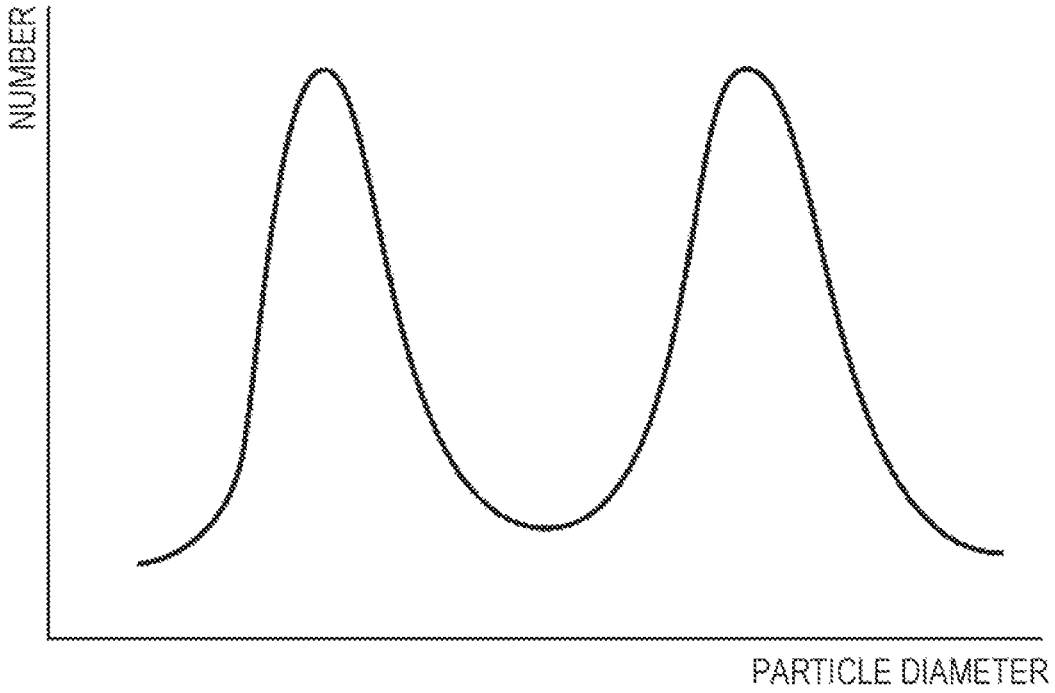
FIG. 11 is a graph schematically showing an example of a particle size distribution of the powder material.

FIG. 11 is a graph schematically showing an example of a particle size distribution of the powder material.

The powder material RM includes the first particle group consisting of the plurality of first particles and the second particle group consisting of the plurality of second particles and having an average particle diameter larger than that of the first particle group (refer to FIG. 11).

By using such a powder material, it is possible to efficiently remove the foreign material CM intruding into a minute space such as a gap between the fibers forming the defibrated material M3, while making removal efficiency of the foreign material CM adhering in a state of being exposed on the outer surface of the defibrated material M3 excellent. As a result, the foreign materials CM can be removed (deinked) from the defibrated material M3 with a high removal rate in short time processing.

On the other hand, satisfactory results can not be obtained unless the above conditions are satisfied.

For example, in a case where the powder material is formed of a single particle group having a relatively small average particle diameter, the time required for removing the foreign material from the defibrated material is long, and it is impossible to sufficiently remove the foreign material by short time processing. In addition, the foreign material once removed from the defibrated material is likely to reattach to the defibrated material. In addition, although it is also conceivable to increase the amount of the powder material used for the defibrated material to prevent the above problem, in such a case, the cost for processing the defibrated material increases, and it is difficult to sufficiently remove the powder material from the defibrated material after the processing. Accordingly, the content of the powder material in the defibrated material after the processing can not be sufficiently lowered and there is a problem that the properties of the defibrated material after the processing and the properties of the sheet manufactured using the defibrated material are deteriorated.

In addition, in a case where the powder material is formed of a single particle group having a relatively large average particle diameter, the removal rate of the foreign material can be relatively increased in a relatively short time from the start of the processing using the powder material, whereas even if the processing time is increased, the removal rate of the foreign material can not be effectively improved. More specifically, it is difficult to remove the foreign material intruding a minute space such as a gap between fibers forming the defibrated material. In addition, in a case where the processing time using the powder material is increased, a phenomenon in which the foreign material intruding into such a minute space is woven into a further narrow space (deep portion) occurs, and it is increasingly difficult to remove the foreign material.

The powder material RM can be suitably prepared by mixing the separately prepared first particle group and the second particle group.

The average particle diameter of the first particle group and the average particle diameter of the second particle group may be obtained from the particle size distribution of each particle group before mixing. The peak particle diameter on the small particle diameter side in the particle size distribution of the powder material RM may be the average particle diameter of the first particle group, and the peak particle diameter on the large particle diameter side in the particle size distribution of the powder material RM may be the average particle diameter of the second particle group (refer to FIG. 11).

The average particle diameter of the second particle group may be larger than the average particle diameter of the first particle group, and there is a preferable range for the degree of divergence between the particle diameters of both. That is, the average particle diameter of the second particle group is preferably two times or more and 10,000 times or less, more preferably 3 times or more and 1,000 times or less, and still more preferably 5 times or more and 100 times or less the average particle diameter of the first particle group.

As a result, the synergistic effect due to containing the first particle group and the second particle group is exhibited more remarkably. In addition, it is possible to effectively prevent from containing excessively minute particles, and to more effectively prevent unintended scattering of the powder material RM (in particular, scattering which is difficult to recover) at the time of deinking processing or the like.

On the other hand, if the divergence between the average particle diameter of the first particle group and the average particle diameter of the second particle group is too small, there is a possibility that the above effect due to the difference in particle diameter may not be fully exhibited. In addition, if the divergence between the average particle diameter of the first particle group and the average particle diameter of the second particle group is too large, the removal rate of the powder material RM in the powder material removing portion 28 decreases or the configuration of the powder material removing portion 28 needs to be complicated in order to increase the removal rate.

The average particle diameter of the first particle group may be smaller than the average particle diameter of the second particle group, and the average particle diameter is preferably 0.01 μm or more and 10 μm or less, more preferably 0.05 μm or more and 7.0 μm or less, and still more preferably 0.1 μm or more and 5.0 μm or less.

As a result, the foreign material CM intruding a minute space such as a gap between the fibers forming the defibrated material M3 can be more efficiently removed, and the removal efficiency of the foreign material CM as a whole of the powder material RM can be made more excellent. In addition, it is possible to effectively prevent from containing excessively minute particles, and to more effectively prevent unintended scattering (in particular, scattering which is difficult to recover) of the powder material RM (in particular, first particle) during the deinking processing or the like.

The minimum particle diameter of the first particle group is preferably 0.01 μm or more and 3.0 μm or less, more preferably 0.02 μm or more and 2.5 μm or less, and still more preferably 0.03 μm or more and 2.0 μm or less.

As a result, the foreign material CM intruding a minute space such as a gap between the fibers forming the defibrated material M3 can be more efficiently removed, and the removal efficiency of the foreign material CM as a whole of the powder material RM can be made more excellent. In addition, it is possible to effectively prevent from containing excessively minute particles, and to more effectively prevent unintended scattering (in particular, scattering which is difficult to recover) of the powder material RM (in particular, first particle) during the deinking processing or the like.

The maximum particle diameter of the first particle group is preferably 0.1 μm or more and 100 μm or less, more preferably 0.2 μm or more and 70 μm or less, and still more preferably 0.3 μm or more and 50 μm or less.

As a result, the foreign material CM intruding a minute space such as a gap between the fibers forming the defibrated material M3 can be more efficiently removed, and the removal efficiency of the foreign material CM as a whole of the powder material RM can be made more excellent.

The average value of the aspect ratios of the first particles forming the first particle group is preferably 1.0 or more and 5.0 or less, more preferably 1.05 or more and 4.9 or less, and still more preferably 1.1 or more and 4.8 or less.

As a result, the foreign material CM intruding a minute space such as a gap between the fibers forming the defibrated material M3 can be more efficiently removed, and the removal efficiency of the foreign material CM as a whole of the powder material RM can be made more excellent.

The content rate of the first particles in the powder material RM is preferably from 10% by volume or more and 90% by volume or less, more preferably 20% by volume or more and 80% by volume or less, and still more preferably 30% by volume or more and 70% by volume or less.

As a result, the synergistic effect due to containing the first particle group and the second particle group is exhibited more remarkably.

In addition, the average particle diameter of the second particle group may be larger than the average particle diameter of the first particle group, and the average particle diameter is preferably 5 μm or more and 1500 μm or less, more preferably 7 μm or more and 1,400 μm or less, and still more preferably 10 μm or more and 1,200 μm or less.

As a result, the removal efficiency of the foreign material CM adhering in a state of being exposed on the outer surface of the defibrated material M3 can be made more excellent, and the removal efficiency of the foreign material CM as a whole of the powder material RM can be made more excellent.

The minimum particle diameter of the second particle group is preferably 0.5 μm or more and 1,000 μm or less, more preferably 0.7 μm or more and 850 μm or less, and still more preferably 1 μm or more and 800 μm or less.

As a result, the removal efficiency of the foreign material CM adhering in a state of being exposed on the outer surface of the defibrated material M3 can be made more excellent, and the removal efficiency of the foreign material CM as a whole of the powder material RM can be made more excellent.

The maximum particle diameter of the second particle group is preferably 5 μm or more and 3,000 μm or less, more preferably 10 μm or more and 2,000 μm or less, and still more preferably 15 μm or more and 1,500 μm or less.

As a result, the removal efficiency of the foreign material CM adhering in a state of being exposed on the outer surface of the defibrated material M3 can be made more excellent, and the removal efficiency of the foreign material CM as a whole of the powder material RM can be made more excellent.

The average value of the aspect ratios of the second particles forming the second particle group is preferably 1.0 or more and 50 or less, more preferably 1.05 or more and 30 or less, and still more preferably 1.1 or more and 20 or less.

As a result, the removal efficiency of the foreign material CM adhering in a state of being exposed on the outer surface of the defibrated material M3 can be made more excellent, and the removal efficiency of the foreign material CM as a whole of the powder material RM can be made more excellent.

When the average value of the aspect ratios of the first particles forming the first particle group is $A_1$ and the average value of the aspect ratios of the second particles forming the second particle group is $A_2$, it is preferable that the relationship of $0.1 \leq A_2/A_1 \leq 50$ be satisfied, it is more preferable that the relationship of $0.5 \leq A_2/A_1 \leq 30$ be satisfied, and it is still more preferable that the relationship of $0.8 \leq A_2/A_1 \leq 15$ be satisfied.

As a result, the synergistic effect due to containing the first particle group and the second particle group is exhibited more remarkably.

The content rate of the second particles in the powder material RM is preferably from 10% by volume or more and 90% by volume or less, more preferably 20% by volume or more and 80% by volume or less, and still more preferably 30% by volume or more and 70% by volume or less.

As a result, the synergistic effect due to containing the first particle group and the second particle group is exhibited more remarkably.

When the content ratio of the first particles in the powder material RM is $X_1$ (% by volume) and the content rate of the second particles in the powder material RM is $X_2$ (% by volume), it is preferable that the relationship of $0.01 \leq X_1/X_2 \leq 10.0$ be satisfied, it is more preferable that the relationship of $0.01 \leq X_1/X_2 \leq 5.0$ be satisfied, and it is still more preferable that the relationship of $0.15\ X_1/X_2 \leq 2.33$ be satisfied.

As a result, the synergistic effect due to containing the first particle group and the second particle group is exhibited more remarkably.

For example, the first particle and the second particle may have the same density, and it is preferable that the first particle and the second particle have mutually different densities from each other.

As a result, the synergistic effect due to containing the first particle group and the second particle group is exhibited more remarkably.

In the specification, unless otherwise specified, density refers to true specific gravity.

In a case where the density of the first particle is different from the density of the second particle, the density of the first particle may be smaller than the density of the second particle, and is preferably greater than the density of the second particle.

As a result, in the deinking processing, the kinetic energy of the first particles (particles having a relatively small particle diameter) can be sufficiently increased, the deinking processing with the first particles (in particular, removal of foreign material CM intruding into a minute space such as a gap between fibers forming defibrated material M3) can be efficiently proceeded, and the kinetic energy of the second particles (particles having a relatively large particle diameter) can be more reliably prevented from being excessively increased. Accordingly, the fiber forming the defibrated material M3 can be more effectively prevented from being damaged (excessively shortening fiber length).

In particular, when the density of the first particles is $\rho_1$ [g/cm$^3$] and the density of the second particles is $\rho_2$ [g/cm$^3$], it is preferable that the relationship of $0.2\ \rho_1/\rho_2 \leq 15$ be satisfied, it is more preferable that the relationship of $0.3\ \rho_1/\rho_2 \leq 10$ be satisfied, and it is still more preferable that the relationship of $0.5\ \rho_1/\rho_2 \leq 5$ be satisfied.

As a result, in the deinking processing, the kinetic energy of the first particles (particles having a relatively small particle diameter) can be sufficiently increased, the deinking processing with the first particles (in particular, removal of foreign material CM intruding into a minute space such as a gap between fibers forming defibrated material M3) can be efficiently proceeded, and the kinetic energy of the second particles (particles having a relatively large particle diameter) can be more reliably prevented from being excessively increased. Accordingly, the fiber forming the defibrated material M3 can be more effectively prevented from being damaged (excessively shortening fiber length).

The density of the first particles is preferably 1.3 g/cm$^3$ or more and 10.0 g/cm$^3$ or less, more preferably 1.8 g/cm$^3$ or more and 8.0 g/cm$^3$ or less, and still more preferably 2.5 g/cm$^3$ or more and 5.0 g/cm$^3$ or less.

As a result, in the deinking processing, the kinetic energy of the first particles can be sufficiently increased, the deinking processing with the first particles (in particular, removal of foreign material CM intruding into a minute space such as a gap between fibers forming defibrated material M3) can be efficiently proceeded. Accordingly, the removal efficiency of the foreign material CM as a whole of the powder material RM can be made more excellent.

The density of the second particles is preferably 0.3 g/cm$^3$ or more and 8.0 g/cm$^3$ or less, more preferably 0.6 g/cm$^3$ or more and 6.2 g/cm$^3$ or less, and still more preferably 0.8 g/cm$^3$ or more and 4.8 g/cm$^3$ or less.

As a result, in the deinking processing, the kinetic energy of the second particles can be more reliably prevented from being excessively increased, the fiber forming the defibrated material M3 can be more effectively prevented from being damaged, and the removal efficiency of the foreign material CM as a whole of the powder material RM can be made more excellent.

In addition, the constituent particles of the powder material RM may be, for example, a porous body or may have minute unevenness on the surface.

The average particle diameter of the powder material RM as a whole is preferably 2.6 μm or more and 255 μm or less, more preferably 5.1 μm or more and 153 μm or less, and still more preferably 10.2 μm or more and 120 μm or less.

As a result, the removal efficiency of the foreign material CM as a whole of the powder material RM can be made more excellent. In addition, it is possible to effectively prevent from containing excessively minute particles, and to more effectively prevent unintended scattering (in particular, scattering which is difficult to recover) of the powder material RM during the deinking processing or the like.

In addition, the ratio (R/L) of the average particle diameter (R) of the powder material RM to the average length (L) of the particles forming the defibrated material M3 is preferably 0.001 or more and 10 or less, more preferably 0.003 or more and 9 or less, and still more preferably 0.005 or more and 8 or less.

As a result, in the deinking processing, the fiber forming the defibrated material M3 can be more effectively prevented from being damaged, and the removal efficiency of the foreign material CM as a whole of the powder material RM can be made more excellent.

The ratio ($\rho_P/\rho_F$) of the average value ($\rho_P$) of the density of the particles forming the powder material RM to the average value ($\rho_F$) of the density of the fiber forming the defibrated material M3 is 0.2 or more and 10 or less, more preferably 0.4 or more and 4.5 or less, and still more preferably 0.5 or more and 3.5 or less.

As a result, in the deinking processing, the defibrated material M3 and the powder material RM can be more suitably mixed, and the removal efficiency of the foreign material CM as a whole of the powder material RM can be made more excellent.

The first particles and the second particles forming the powder material RM may have the same composition as or may have different compositions from each other.

The composition of the powder material RM (first particle and second particle) is not particularly limited, and examples of the constituent material of the powder material RM include various resin materials such as various thermoplastic resins and various thermosetting resins, cellulose type materials such as cellulose, cellulose-modified materials (for example, methylcellulose, carboxymethylcellulose and salts thereof (for example, sodium salt and the like)), a material having a sugar chain structure such as starch, alginic acid, and chitosan, glass, calcium carbonate, metal compounds such as titanium oxide and alumina, and plant materials such as a crushed outer shell of the seed of the plant (seeds of walnut, peach, apricot, and the like), and a crushed actual shell of the plant fruit (dried corn grain, dried wheat endosperm, and the like). For example, both of the first particle and the second particle may be formed of a resin material, or the first particle may be formed of a cellulose-based material and the second particle may be formed of a metal compound.

Examples of thermoplastic resin include polyolefins such as polyethylene, polypropylene, ethylene-vinyl acetate copolymer, a liquid crystal polymer such as modified polyolefin, polyamide (example: nylon 6, nylon 46, nylon 66, nylon 610, nylon 612, nylon 11, nylon 12, nylon 6-12, nylon 6-66), thermoplastic polyimide, aromatic polyester, various thermoplastic elastomers such as polyphenylene oxide, polyphenylene sulfide, polycarbonate, polymethyl methacrylate, polyether, polyether ether ketone, polyether imide, polyacetal, styrene type, polyolefin type, polyvinyl chloride type, polyurethane type, polyester type, polyamide type, polybutadiene type, trans polyisoprene type, fluoro rubber type, chlorinated polyethylene type, or copolymers mainly containing these, blends, polymer alloys.

Examples of thermosetting resin include an epoxy resin, a phenol resin, a urea resin, a melamine resin, polyester (unsaturated polyester) resin, polyimide resin, silicone resin, polyurethane resin, and the like.

In particular, the powder material RM preferably contains a substance having at least one of a hydroxyl group and a carboxyl group. This substance may contain two or more types as exemplified below. For example, the substance may contain a compound having a hydroxyl group and having no carboxyl group, and a compound having a carboxyl group and having no hydroxyl group.

In a case where the powder material RM contains the substance, so that the foreign material CM is contained in the defibrated material M3, the foreign material CM can be removed more efficiently. Such excellent effects can be obtained for the following reasons.

That is, in general, a recording material such as ink or toner used for a recording medium such as paper is designed so as to have excellent affinity and adhesion to cellulose fiber serving as the main material of the recording medium. On the other hand, the cellulose fiber contains a polymer material containing β-glucose having a large number of hydroxyl groups in the molecule as a constituent monomer, and is a highly hydrophilic material.

The powder material RM supplies such a fiber-containing material containing cellulose fiber to the defibrated material M3 which is defibrated. When the powder material RM contains a highly hydrophilic substance having at least one of a hydroxyl group and a carboxyl group, the powder material RM exhibits a polarity (hydrophilicity) similar to that of the cellulose fiber.

Therefore, such a powder material RM has high affinity with the foreign material CM derived from a recording material such as ink and toner, and in a case where the powder material RM comes into contact with the defibrated material containing the foreign material CM, it is possible to effectively adsorb the foreign material CM, and to efficiently remove the foreign material CM from the defibrated material M3. In addition, even in a case where such a powder material RM remains in the defibrated material M3 after the deinking processing, normally, it is possible to sufficiently reduce adverse effects on the defibrated material M3 after the deinking processing and the sheet S manufactured by using the defibrated material M3. In addition, in some cases, it is possible to obtain an effect such that the sheet S to be manufactured can be made more excellent in paper strength, affinity to a recording material such as ink, toner, or the like.

When the powder material RM contains a substance having at least one of a hydroxyl group and a carboxyl group, by the electrostatic interaction with foreign material CM, it is possible to adsorb the foreign material CM contained in the defibrated material M3 from the fiber (cellulose fiber).

As a result, the foreign material CM contained in the defibrated material M3 can be more efficiently removed. In particular, when the powder material RM is supplied so as to collide with the defibrated material M3, by the electrostatic interaction, collision between the foreign material CM contained in the defibrated material M3 and the powder material RM is likely to occur. Accordingly, the removal efficiency of foreign material CM contained in the defibrated material M3 can be made more excellent. In addition, it is possible to more effectively prevent unintended aggregation of constituent particles of the powder material RM due to electrical repulsion between particles forming the powder material RM. In addition, in a case where a relatively small amount of the powder material RM is contained in the defibrated material M3 after the deinking processing (for example, 0.01% by mass or more and 0.5% by mass or less), the sheet S to be manufactured by using the defibrated material M3 can be made more excellent in paper strength, affinity to a recording material such as ink, toner, or the like.

In a case where the powder material RM contains the substance (substance having at least one of a hydroxyl group and a carboxyl group), the substance is preferably solid at ordinary temperature (25° C.) and has preferably a hydrophilic material.

As a result, the foreign material CM contained in the defibrated material M3 can be more efficiently removed. In addition, separation and removal of the powder material RM (powder material RM') from the defibrated material M3 subjected to the deinking processing can be performed more easily and more reliably.

The degree of hydrophilicity of the substance is not particularly limited, and it is preferable that the solubility in water at 25° C. be 1 g/100 $gH_2O$ or more, or the contact angle of water be 90° or less.

As a result, the above-described effect is more remarkably exhibited.

The solubility of the substance in water at 25° C. is preferably 1.0 g/100$gH_2O$ or more, more preferably 2.0 g/100$gH_2O$ or more and 70 g/100$gH_2O$ or more, and still preferably 3.0 g/100$gH_2O$ or more and 50 g/100$gH_2O$ or less.

As a result, the above-described effect is more remarkably exhibited.

In addition, the contact angle of water with respect to the substance at 25° C. is preferably 90° or less, more preferably 60° or less, and still more preferably 45° or less.

As a result, the above-described effect is more remarkably exhibited.

In a case where the powder material RM contains a substance having at least one of a hydroxyl group and a carboxyl group, the substance may be a low molecular weight material, and is preferably a polymer material.

As a result, an adsorption property of the foreign material CM can be made more excellent. In addition, separation and removal of the powder material RM (powder material RM') from the defibrated material M3 subjected to the deinking processing can be performed more easily and more reliably.

The weight average molecular weight of the polymer material is preferably 2,000 or more and 3,000,000 or less, more preferably 5,000 or more and 2,000,000 or less, and still more preferably 10,000 or more and 1,000,000 or less.

As a result, the above-described effect is more remarkably exhibited.

The substance may contain both such a polymeric material and a low molecular weight material.

The polymeric material forming the powder material RM is preferably one having a sugar chain structure.

In general, the compound having a sugar chain structure has a high hydroxyl group ratio (ratio of the number of hydroxyl groups to the molecular weight) in the molecule, can improve the hydrophilicity of the powder material RM as a whole, and can make the adsorption property of foreign material CM as a whole of the powder material RM higher.

Examples of the polymer material having a sugar chain structure include cellulose, a cellulose-modified material (for example, methyl cellulose, carboxymethyl cellulose or a salt thereof (for example, sodium salt and the like)), starch, alginic acid, chitosan, and the like. Among these, it is preferable to contain at least one of cellulose and a cellulose-modified material, and it is more preferable to contain a salt of carboxymethyl cellulose.

In such a material, the adsorption ability of the foreign material CM is particularly high, and the foreign material CM can be removed more efficiently. In addition, such a material is relatively inexpensive and easy to obtain. In addition, in a case where a relatively small amount of the powder material RM is contained in the defibrated material M3 after the deinking processing (for example, 0.01% by mass or more and 0.5% by mass or less), the sheet S to be manufactured by using the defibrated material M3 can be made more excellent in paper strength, affinity to a recording material such as ink, toner, or the like.

As the powder material RM, paper powder may be used.

As the polymer material, a synthetic resin material may be used.

As a result, the adsorption property of the foreign material CM can be made more excellent. In addition, separation and removal of the powder material RM (powder material RM') from the defibrated material M3 subjected to the deinking processing can be performed more easily and more reliably.

Examples of the synthetic resin material include polyvinyl alcohol (PVA), poly (meth) acrylic acid, polymer containing monomer having a terminal OH group as a constituent component (for example, poly (meth) acrylic resin containing monomer components such as hydroxyethyl (meth) acrylate, hydroxybutyl (meth) acrylate), and the like.

In a case where the powder material RM contains a substance having at least one of a hydroxyl group and a carboxyl group, the powder material RM may contain components (other components) other than the above-described substances (substance having at least one hydroxyl group and carboxyl group).

In such a case, the content of the substance (substance having at least one of a hydroxyl group and a carboxyl group) in the powder material RM is preferably 30% by mass or more, more preferably 40% by mass or more, and still more preferably 50% by mass or more.

As a result, the above-described effect is more remarkably exhibited.

In a case where only one of the first particle and the second particle is formed of the substance (substance having at least one of a hydroxyl group and a carboxyl group), it is preferable that the second particle be formed of the substance (substance having at least one of a hydroxyl group and a carboxyl group) and the first particle be formed of a material other than the substance (substance having at least one of a hydroxyl group and a carboxyl group).

As a result, the interaction between the first particle intruding a minute space such as a gap between the fibers forming the defibrated material M3 and the fiber (cellulose fiber) is too strong, while effectively preventing the first particle from being unintentionally remaining (being remaining at a relatively high rate) in the defibrated material M3 after the deinking processing without being removed, the removal efficiency of the foreign material CM as a whole of the powder material RM can be made more excellent.

Second Embodiment

Figure 5:
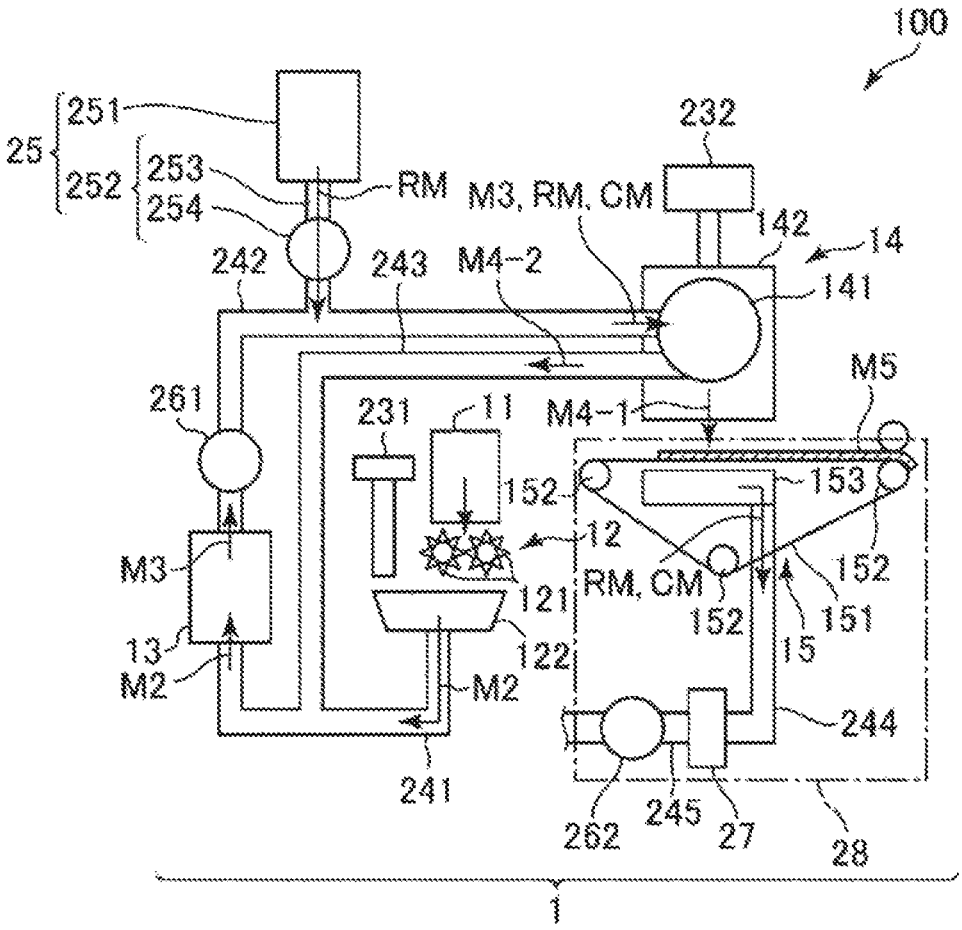
FIG. 5 is a schematic side view showing an upstream side of a second embodiment of the sheet manufacturing apparatus (including processing apparatus of the invention) of the invention.
Figure 6:
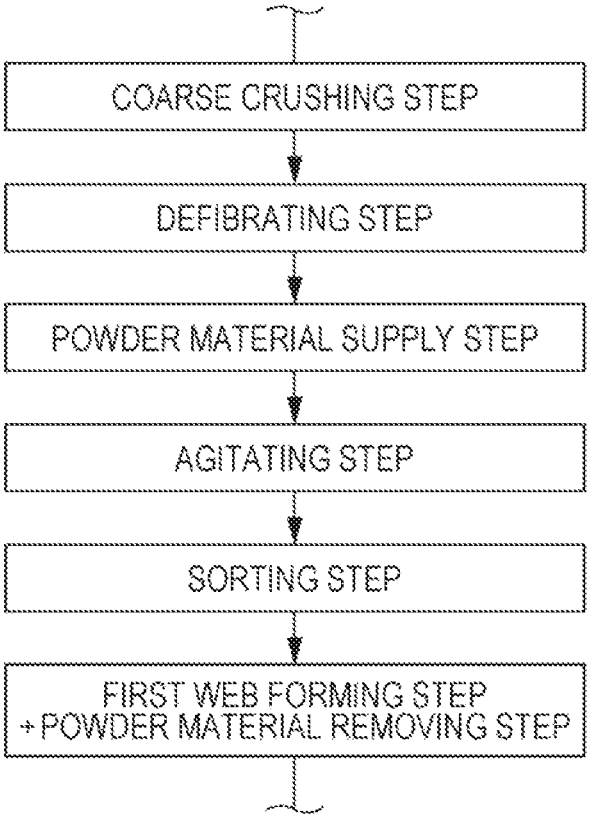
FIG. 6 is a flow chart sequentially showing steps performed by the sheet manufacturing apparatus shown in FIG. 5.

FIG. 5 is a schematic side view showing an upstream side of a second embodiment of the sheet manufacturing apparatus (including processing apparatus of the invention) of the invention. FIG. 6 is a flow chart sequentially showing steps performed by the sheet manufacturing apparatus shown in FIG. 5.

Hereinafter, a second embodiment of the processing apparatus, sheet manufacturing apparatus, processing method, and sheet manufacturing method of the invention will be described with reference to these drawings. The differences from the above-described embodiment will be mainly described, and description of similar matters will be omitted.

This embodiment is the same as the first embodiment except that the arrangement position of the powder material supply portion is different and accordingly the timing of performing the powder material supply step is different from these of the first embodiment.

As shown in FIG. 5, the sheet manufacturing apparatus 100 (processing apparatus 1) is provided with the pipe (flow path) 242 connected to the defibrating portion 13 and through which the fiber-containing material (defibrated material) M3 passes.

The powder material supply portion 25 performs the powder material supply step of supplying the powder material RM to the fiber-containing material (defibrated material) M3 after defibrating after the defibrating step (refer to FIG. 6). The powder material supply portion 25 is connected to the downstream side of the blower 261 of the pipe (flow path) 242, and has the ejecting portion 252 for ejecting the powder material RM into the pipe (flow path) 242. As a result, it is possible to supply and mix the powder material RM to the defibrated material M3 sufficiently defibrated. By such supply and mixing, the powder material RM spreads to every corner of the defibrated material M3, and as a result collides with and comes into contact the foreign material CM. As a result, the foreign material CM is sufficiently adsorbed to the powder material RM, and the foreign material CM can be more reliably removed from the defibrated material M3.

Third Embodiment

Figure 7:
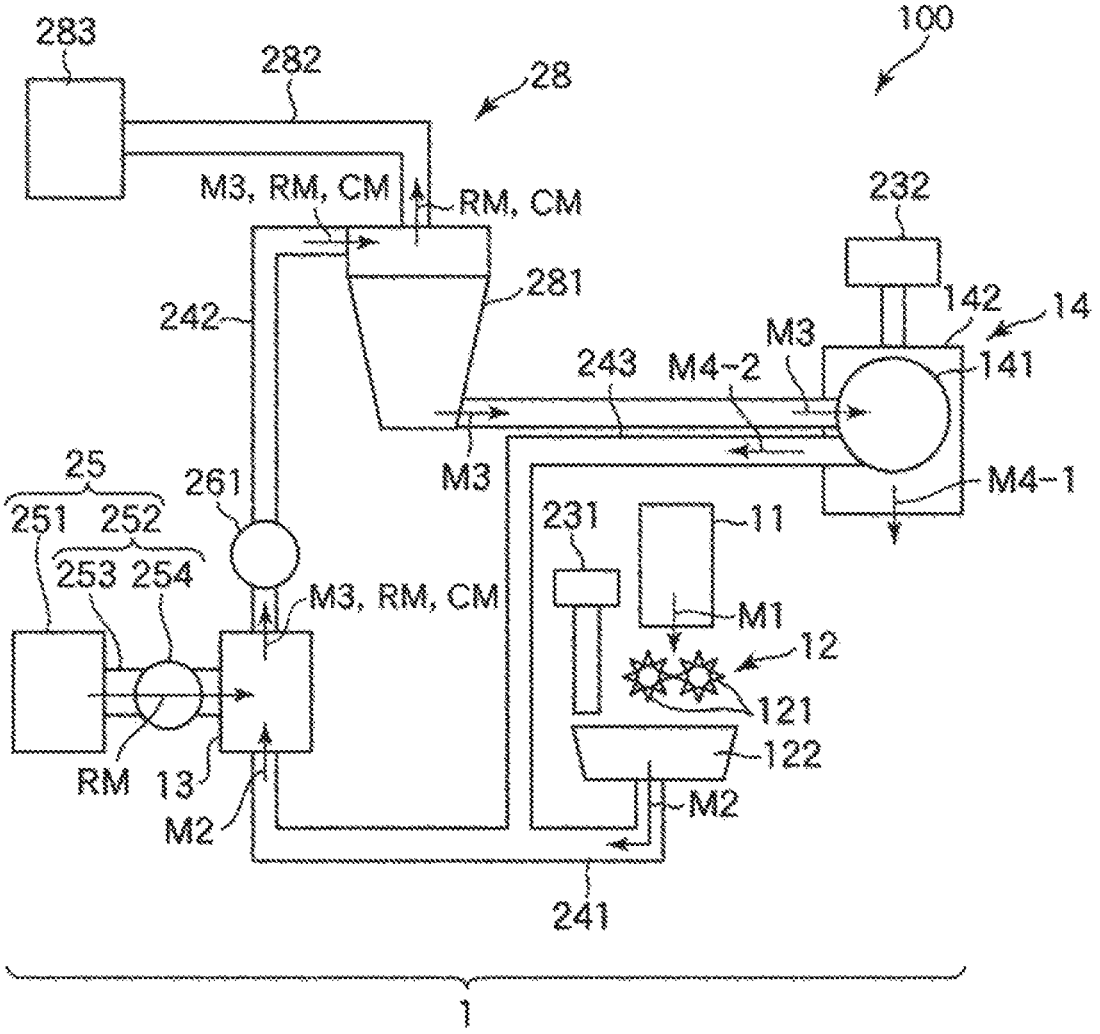
FIG. 7 is a schematic side view showing an upstream side of a third embodiment of the sheet manufacturing apparatus (including processing apparatus of the invention) of the invention.
Figure 8:
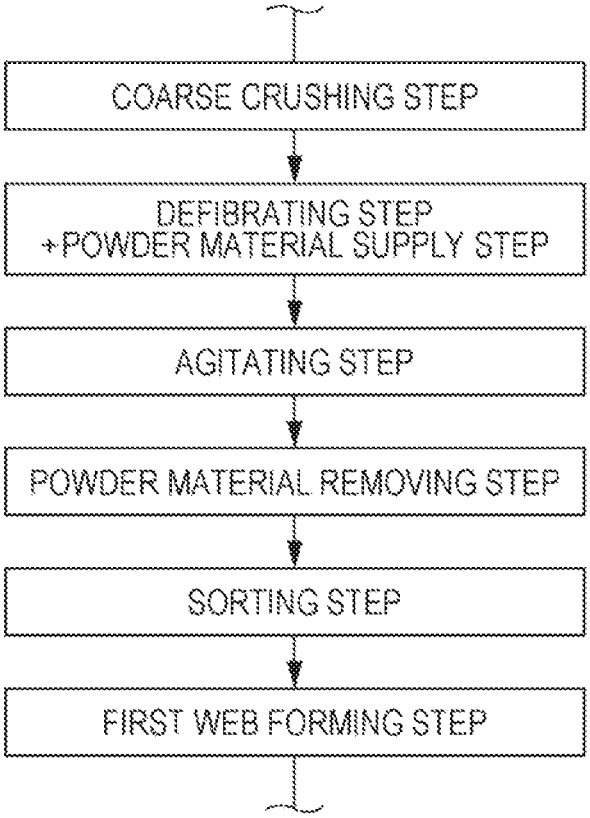
FIG. 8 is a flow chart sequentially showing steps performed by the sheet manufacturing apparatus shown in FIG. 7.

FIG. 7 is a schematic side view showing an upstream side of a third embodiment of the sheet manufacturing apparatus (including processing apparatus of the invention) of the invention. FIG. 8 is a flow chart sequentially showing steps performed by the sheet manufacturing apparatus shown in FIG. 7.

Hereinafter, a third embodiment of the processing apparatus, sheet manufacturing apparatus, processing method, and sheet manufacturing method of the invention will be described with reference to these drawings. The differences from the above-described embodiment will be mainly described, and description of similar matters will be omitted.

This embodiment is the same as the first embodiment except that the arrangement position of the powder material removing portion and the configuration of the powder material removing portion are different from these of the first embodiment.

As shown in FIG. 7, in the embodiment, the powder material removing portion 28 is disposed in the middle of the pipe 242 and on the downstream side of the blower 261. As a result, the powder material removing step in the powder material removing portion 28 is performed after the defibrating step (refer to FIG. 8).

The powder material removing portion 28 separates and removes the powder material RM (powder material RM') by utilizing a difference (density difference) in density (specific gravity) between the defibrated material M3 and the powder material RM (powder material RM'). That is, the powder material removing portion 28 is configured to remove the powder material RM (powder material RM') by centrifugal separation, and includes a centrifugal separating portion 281, a pipe 282, and a collecting portion 283. The centrifugal separating portion 281 and the collecting portion 283 are connected to each other via the pipe 282.

The centrifugal separating portion 281 is disposed and connected in the middle of the pipe 242. The defibrated material M3 and the powder material RM (powder material RM') passed through the pipe 242 collectively flow into the centrifugal separating portion 281. The powder material RM flowing into the centrifugal separating portion 281 includes the powder material RM adsorbed by the foreign material CM, that is, the powder material RM', and the powder material RM not adsorbed by the foreign material CM. By centrifugal separation in the centrifugal separating portion 281, these materials are divided into the defibrated material M3 that flows further down the pipe 242 toward the sorting portion 14, and the powder material RM (powder material RM') that flows toward the pipe 282. The powder material RM (powder material RM') directed to the pipe 282 passes through the pipe 282 with the foreign material CM and is collected by the collecting portion 283.

Even with such a powder material removing portion 28, it is possible to efficiently remove the foreign material CM from the defibrated material M3 with the powder material RM.

Fourth Embodiment

Figure 9:
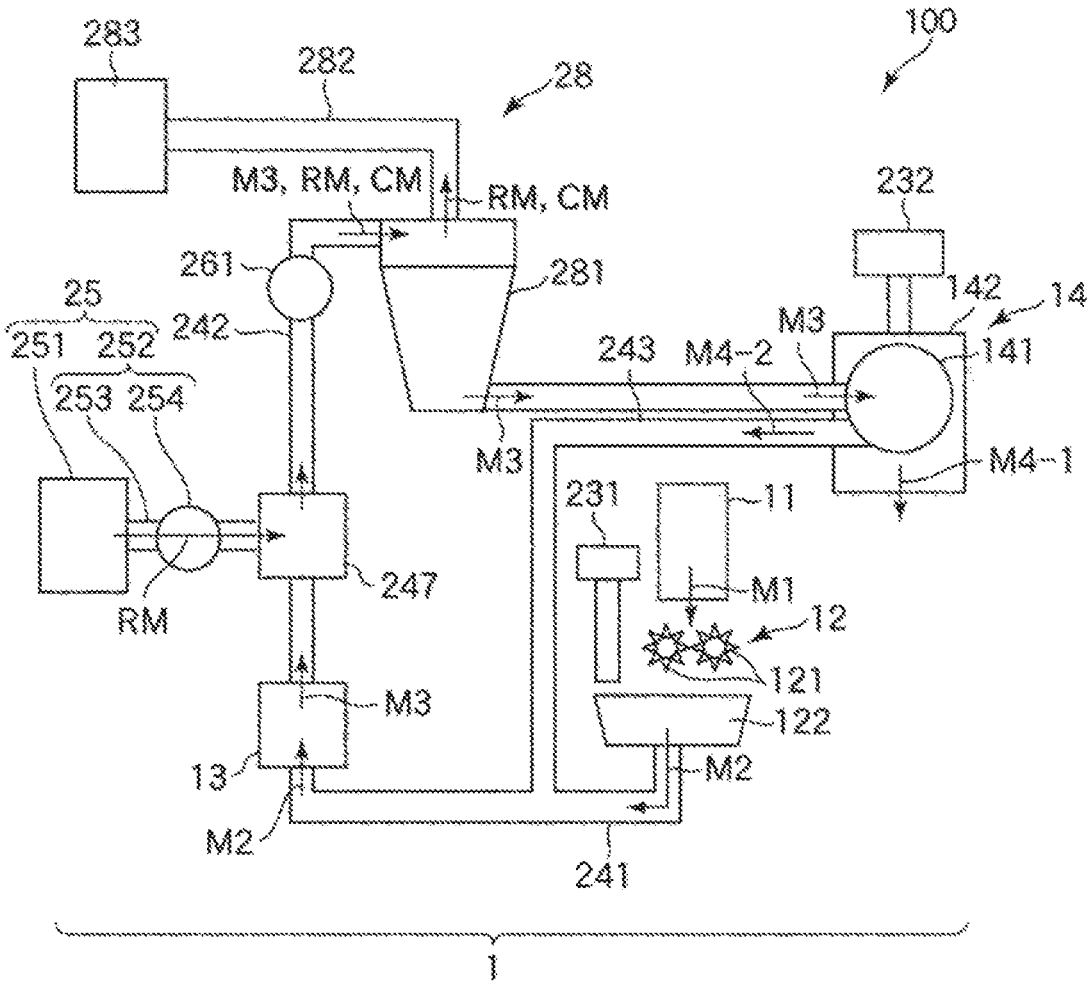
FIG. 9 is a schematic side view showing an upstream side of a fourth embodiment of the sheet manufacturing apparatus (including processing apparatus of the invention) of the invention.
Figure 10:
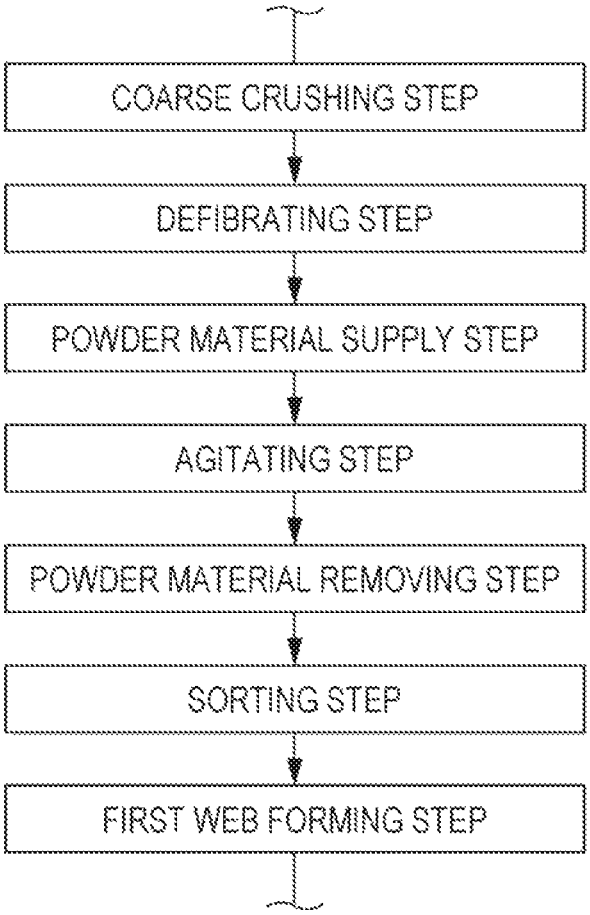
FIG. 10 is a flow chart sequentially showing steps performed by the sheet manufacturing apparatus shown in FIG. 9.

FIG. 9 is a schematic side view showing an upstream side of a fourth embodiment of the sheet manufacturing apparatus (including processing apparatus of the invention) of the invention. FIG. 10 is a flow chart sequentially showing steps performed by the sheet manufacturing apparatus shown in FIG. 9.

Hereinafter, a fourth embodiment of the processing apparatus, sheet manufacturing apparatus, processing method, and sheet manufacturing method of the invention will be described with reference to these drawings. The differences from the above-described embodiment will be mainly described, and description of similar matters will be omitted.

This embodiment is the same as the third embodiment except that the arrangement position of the powder material supply portion is different from that of the third embodiment, and an agitating portion 247 for agitating a mixture of the defibrated material M3 and the powder material RM is provided at a portion on the downstream side of the defibrating portion 13 and the powder material supply portion 25, and on the upstream side of the powder material removing portion 28.

As shown in FIG. 9, in the embodiment, the powder material supply portion 25 is connected between the defibrating portion 13 and the cyclone type powder material removing portion 28 (centrifugal separating portion 281), so that the powdered material RM is supplied to the defibrated material M3 which is defibrated from the defibrating portion 13 and discharged. As a result, the powder material supply step in the powder material supply portion 25 is performed after the defibrating step, and the powder material removing step is performed after the powder material supply step (refer to FIG. 10). Although the arrangement position of the powder material supply portion 25 is on the upstream side of the powder material removing portion 28, it is preferably further on the upstream side of the blower 261.

The agitating portion 247 has a chamber provided on the downstream side of the defibrating portion 13, and a rotary blade rotating in the chamber. As a result, the defibrated material M3 and the powder material RM can be efficiently mixed and agitated, and the opportunity for collision between the powder material RM and the foreign material CM is increased, and thus adsorption of the foreign material CM can be promoted.

The space inside the chamber is an agitating space for mixing and agitating the defibrated material M3 and the deinking agent RM.

When the defibrated material M3 and the deinking agent RM are supplied to the agitating space, these are mixed and agitated by the rotation of the rotary blade. As a result, the defibrated material M3 collides with the deinking agent RM efficiently, and removal of the foreign material CM from the defibrated material M3 is promoted.

Furthermore, the speed at which the powder material RM passes through the pipe 242 increases by the action of the blower 261. As a result, the opportunity for the powder material RM to collide with the defibrated material M3 increases and as a result it also comes in contact with the foreign material CM adhering to the defibrated material M3 and adsorption of the foreign material CM is promoted.

The powder material RM (powder material RM') adsorbed the foreign material CM is removed by the powder material removing portion 28.

Hereinbefore, although preferred embodiments of the invention are described, the invention is not limited thereto.

For example, each part forming the processing apparatus and the sheet manufacturing apparatus can be replaced with any configuration capable of exhibiting the same function. In addition, any components may be added.

In addition, the processing apparatus, the sheet manufacturing apparatus, the processing method, and the sheet manufacturing method of the invention may be any combination of two or more configurations (features) of the above embodiments.

In addition, in the above-described embodiment, a case where the powder material removing portion separates the deinking agent and the defibrated material by utilizing one of the differences in the density and the difference in size described, and the powder material removing portion may separate by utilizing both the differences in the density between the deinking agent and the defibrated material, and the difference in size between the deinking agent and the fibrillated material.

In addition, in the invention, the powder material may contain at least one particle which does not belong to any of the first particle group and the second particle group.

In addition, in the above-described embodiment, although the removal of foreign material from the defibrated material is typically described by adsorption, the foreign material may be removed by a mechanism other than adsorption. For example, by causing the powder material to collide with the defibrated material, the foreign material may be separated without adsorption to the powder material (particle) to remove the foreign material from the defibrated material.

In addition, the contact between the fiber-containing material and the powder material is not limited to that performed by the above-described configuration, and may be performed by an air flow agitating, for example.

In addition, in the above-described third and fourth embodiment, a case where the powder material removing portion is provided with the cyclone type centrifugal separating portion is described, an apparatus having a mesh (sieve) may be adopted instead of the centrifugal separating portion.

EXAMPLES

Next, specific examples of the invention will be described.

[1] Preparation of Powder Material (Deinking Agent)

Example 1

First, calcium carbonate powder having an average particle diameter of 5 μm, a minimum particle diameter of 1 μm, and a maximum particle diameter of 10 μm was prepared as a first particle group. The average value of the aspect ratios of the particles (first particles) forming the first particle group was 1.3.

On the other hand, a commercially available powdered carboxymethyl cellulose sodium salt (manufactured by Wako Pure Chemical Industries, Ltd.) was prepared.

The powdery sodium salt of carboxymethyl cellulose was subjected to classification processing using a classification device to obtain a plurality of fractions. Among these, a fraction having an average particle diameter of 120 μm, a minimum particle diameter of 25 μm, and a maximum particle diameter of 150 μm was defined as a second particle group. The average value of the aspect ratios of the particles (second particles) forming the second particle group was 15.

The first particle group and the second particle group as described above were mixed at a volume ratio of 1:10 to obtain a powder material (deinking agent) as a mixed powder.

Examples 2 to 10

A powder material (deinking agent) as a mixed powder was obtained in the same manner as in Example 1 except that the conditions (constituent materials, material particle size distribution) of the first particle group and the second particle group are set as shown in Table 1, and the mixing ratio of the first particle group and the second particle group was changed as shown in Table 1.

In the powder material (deinking agent) according to each of the above-described examples, the average particle diameter of the powder material as a whole was 1 μm or more and 100 μm or less in any case. In addition, regarding those containing the particle group containing particles formed of sodium salt of carboxymethyl cellulose (CMC-Na) of the powder material (deinking agent) according to each of the above examples, the weight average molecular weight of the CMC-Na was 10,000 or more and 1,000,000 or less in any case. In addition, the CMC-Na contained in the powder material (deinking agent) according to the example had solubility in water at 25° C. of 3.0 g/100g$H_2O$ or more and 50 g/100g$H_2O$ less, or the contact angle of water was 45° or less in any case.

Comparative Example 1

A powder material (deinking agent) was obtained in the same manner as in Example 1 except that the fraction having an average particle diameter of 15 μm, a minimum particle diameter of 1 and a maximum particle diameter of 25 μm was used as it was as a powder material (deinking agent) among the powders of sodium salt of carboxymethyl cellulose fractionated in the same manner as in Example 1. That is, the powder material (deinking agent) according to this comparative example is formed of a single particle group.

Comparative Example 2

A powder material (deinking agent) was obtained in the same manner as in Example 1 except that the fraction having an average particle diameter of 120 μm, a minimum particle diameter of 25 μm, and a maximum particle diameter of 150 μm was used as it was as a powder material (deinking agent) among the powders of sodium salt of carboxymethyl cellulose fractionated in the same manner as in Example 1. That is, the powder material (deinking agent) according to this comparative example is formed of a single particle group.

The conditions of the powder materials (deinking agent) according to each example and each comparative example are summarizes in Table 1.

TABLE 1

| | First particle group | | | | | | | |
|---|---|---|---|---|---|---|---|---|
| | Constituent material | Average particle diameter [μm] | Minimum particle diameter [μm] | Maximum particle diameter [μm] | Aspect ratios | Density [g/cm$^3$] | Content [% by mass] | Second particle group Constituent material |
| Example 1 | $CaCO_3$ | 5 | 1 | 10 | 1.3 | 2.93 | 18.6 | CMC-Na |
| Example 2 | $CaCO_3$ | 5 | 1 | 10 | 1.3 | 2.93 | 18.6 | NaCl |
| Example 3 | $CaCO_3$ | 5 | 1 | 10 | 1.3 | 2.93 | 18.6 | Starch |
| Example 4 | $CaCO_3$ | 5 | 1 | 10 | 1.3 | 2.93 | 18.6 | Polyacrylic acid |
| Example 5 | $CaCO_3$ | 5 | 1 | 10 | 1.3 | 2.93 | 18.6 | Methylcellulose |
| Example 6 | $CaCO_3$ | 5 | 1 | 10 | 1.3 | 2.93 | 18.6 | Nylon |
| Example 7 | $CaCO_3$ | 5 | 1 | 10 | 1.3 | 2.93 | 18.6 | Alumina |
| Example 8 | $CaCO_3$ | 0.15 | 0.05 | 0.3 | 1.3 | 2.93 | 18.6 | CMC-Na |
| Example 9 | $TiO_2$ | 0.21 | 0.1 | 0.3 | 1.1 | 4.3 | 11.4 | CMC-Na |
| Example 10 | Talc | 5 | 2 | 50 | 1.1 | 2.7 | 9.6 | CMC-Na |
| Comparative Example 1 | CMC-Na | 15 | 1 | 25 | 1.2 | 1.6 | 34.4 | — |
| Comparative Example 2 | — | — | — | — | — | — | — | CMC-Na |

| | Second particle group | | | | | |
|---|---|---|---|---|---|---|
| | Average particle diameter [μm] | Minimum particle diameter [μm] | Maximum particle diameter [μm] | Aspect ratios | Density [g/cm$^3$] | Content [% by mass] |
| Example 1 | 120 | 25 | 150 | 15 | 1.6 | 34.4 |
| Example 2 | 1200 | 850 | 1400 | 1.1 | 2.16 | 52.8 |
| Example 3 | 30 | 10 | 100 | 1.5 | 1.4 | 42.9 |
| Example 4 | 100 | 30 | 250 | 1.7 | 1.2 | 41.7 |
| Example 5 | 100 | 2 | 500 | 12 | 1.6 | 31.3 |
| Example 6 | 10 | 3 | 18 | 1.2 | 1.1 | 45.5 |

TABLE 1-continued

| | | | | | | |
|---|---|---|---|---|---|---|
| Example 7 | 50 | 45 | 53 | 1.2 | 3.54 | 49.7 |
| Example 8 | 120 | 25 | 150 | 15 | 1.6 | 34.4 |
| Example 9 | 120 | 25 | 150 | 15 | 1.6 | 34.4 |
| Example 10 | 120 | 25 | 150 | 15 | 1.6 | 34.4 |
| Comparative Example 1 | — | — | — | — | — | — |
| Comparative Example 2 | 120 | 25 | 150 | 15 | 1.6 | 34.4 |

[2] Deinking Processing and Manufacture of Sheet

Using the powder materials (deinking agent) prepared in each of the above Examples and Comparative Examples, the following processing (deinking processing) and manufacture of a sheet were performed.

First, the sheet manufacturing apparatus having the configuration shown in FIG. 1 was prepared, and commercially available copy paper was subjected to monochrome printing of 10% duty on one side with an ink jet printer (PX-M7050FT manufactured by Seiko Epson Corporation) was prepared as a raw material. The mesh opening of the mesh belt (mesh body) included in the first web forming portion of the powder material removing portion of the sheet manufacturing apparatus was 600 μm.

Next, the above raw material was supplied to the raw material supply portion of the sheet manufacturing apparatus, the sheet manufacturing apparatus was operated, and the raw material was subjected to processing such as crushing, defibrating, deinking and the like to produce a sheet.

At this time, the supply amount of the powder material (deinking agent) to 100 parts by mass of the fiber-containing material (defibrated material) was 100 parts by mass. The manufacturing conditions of the sheets were the same in each of the examples and the comparative examples except that the type of the powder material (deinking agent) was changed.

In each of the above embodiments, the ratio (R/L) of the average particle diameter (R) of the powder material as a whole to the average length (L) of the fiber forming the defibrated material to be subjected to the deinking processing was 0.001 or more and 10 or less in any case. In addition, in each of the above examples, the ratio ($\rho_P/\rho_F$) of the average value ($\rho_P$) of the density of the particles forming the powder material to the average value ($\rho_F$) of the density of the fiber forming the defibrated material to be subjected to the deinking processing was 0.2 or more and 10 or less in any case.

[3] Evaluation

[3-1] Coloring of Defibrated Material after Deinking Processing (Remaining Foreign Material)

For each of the examples and each of the comparative examples, a portion of the first web formed in the first web forming portion was taken out and observed with a digital microscope (VHX-5000 manufactured by Keyence Corporation). Compared with the state of the first web in a case where the processing was performed in the same manner as above except that the powder material (deinking agent) was not used, the remaining state of the foreign material derived from the recording material (ink) was evaluated according to the following criteria.

A: No remaining foreign material is observed.

B: Almost no remaining foreign material is observed.

C: Remaining foreign material is slightly observed.

D: Remaining foreign material is observed.

E: Remaining foreign material is significantly observed.

These results are summarized in Table 2.

TABLE 2

| | Remaining foreign material |
|---|---|
| Example 1 | A |
| Example 2 | D |
| Example 3 | B |
| Example 4 | B |
| Example 5 | C |
| Example 6 | C |
| Example 7 | B |
| Example 8 | D |
| Example 9 | D |
| Example 10 | C |
| Comparative Example 1 | E |
| Comparative Example 2 | E |

As is apparent from Table 2, excellent results were obtained in the invention. That is, in the invention, the powder material (deinking agent) efficiently adsorbed the foreign material contained in the defibrated material, and the foreign material could be efficiently removed. In addition, in the invention, the whiteness of the manufactured sheet was excellent, and unintended coloring or unintended color unevenness due to remaining foreign material was not observed. In addition, in the invention, separability between the defibrated material subjected to the deinking treatment and the powder material (deinking agent) was also excellent. In each of the above examples, the removal rate of the powder material in the powder material removing portion was 90% or more in any case, and the removal rate of the second particle was higher than the removal rate of the first particle. On the contrary, satisfactory results were not obtained in the comparative example.

In addition, deinking processing and sheet manufacture were performed in the same manner as described above except that the supply amount of the powder material (deinking agent) to 100 parts by mass of the defibrated material was variously changed in the range of 10 parts by mass or more and 100,000 parts by mass or less, and the same evaluation as above was performed, and the same results as described above were obtained.

In addition, the deinking processing and the sheet manufacture were performed in the same manner as described above except the apparatus used for the deinking processing and the sheet manufacture was changed to the one having the construction shown in FIG. 5, the one having the construction shown in FIG. 7, and the one shown in FIG. 9.

Hereinafter, preferred embodiments of the invention will be described in detail with reference to the same drawings used in the first to fourth embodiments. In addition, also in the embodiment of the invention, the same operation as that of the first to the fourth embodiments is applied and similar drawings (FIGS. 1 to 10) are applied, so duplicate explanation will be omitted. Therefore, it is assumed that the first to fourth embodiments are similarly applied to an application not described below. Also in the embodiment, "deinking" and "processing" are the same as those in the first embodiment.

Fifth Embodiment

A processing apparatus 1 of the invention is provided with a powder material supply portion 25 that supplies a powder material RM containing a first particle and a second particle having a different composition from that of the first particle, to the fiber-containing material M3 containing a fiber during or after defibrating, and a powder material removing portion 28 that removes at least a portion of the powder material RM from the fiber-containing material M3 supplied with the powder material RM.

In addition, a processing method of the invention is provided with a powder material supply step of supplying a powder material RM containing a first particle and a second particle having a different composition from that of the first particle, to the fiber-containing material M3 containing a fiber during or after defibrating, an agitating step of agitating the powder material and the fiber-containing material in a state where the powder material RM and the fiber-containing material M3 are mixed, and a powder material removing step of removing at least a portion of the powder material RM from the fiber-containing material M3 supplied with the powder material RM. This method is performed by the processing apparatus 1.

According to the invention as described above, as described later, even in a case where a foreign material CM derived from a recording material such as ink or toner (for example, a colorant, a binder resin, a charge control agent, or the like) is contained in the fiber-containing material M3, the foreign material CM can be efficiently removed from the fiber-containing material M3 by the powder material (deinking agent) RM. That is, the foreign material CM can be removed (deinked) from the fiber-containing material M3 with a high removal rate in short time processing. In addition, thereafter, the foreign material CM can also be removed with the powder material RM by the powder material removing portion 28 (powder material removing step). In particular, it is possible to remove the foreign material CM in a dry manner without requiring a large amount of water or large equipment.

In addition, the first particle and the second particle are terms indicating the relative relationship between these, and the powder material may contain three or more types of particles formed of different materials from each other. However, in a case where the powder material contains three or more types of particles formed of different materials from each other, it is preferable that one of the two types of particles having the highest content ratio in the powder material be the first particle and the other one be the second particle.

The sheet manufacturing apparatus 100 of the invention is provided with the processing apparatus 1.

In addition, a sheet manufacturing method of the invention is provided with a powder material supply step of supplying a powder material RM containing a first particle and a second particle having a different composition from that of the first particle, to the fiber-containing material M3 containing a fiber during or after defibrating, an agitating step of agitating the powder material and the fiber-containing material in a state where the powder material RM and the fiber-containing material M3 are mixed, and a powder material removing step of removing at least a portion of the powder material RM from the fiber-containing material M3 supplied with the powder material RM, and the sheet S is manufactured from the fiber-containing material M3 from which the powder material RM is removed. This method is performed by the sheet manufacturing apparatus 100.

According to the invention as described above, the sheet S is further manufactured (reproduced) from the material from which the foreign material CM derived from the recording material such as ink, toner or the like (for example, a colorant, a binder resin, a charge control agent, or the like) is removed while enjoying the advantages of the above-described processing apparatus 1 (processing method). In particular, it is possible to manufacture the sheet S with high whiteness in a dry manner without requiring a large amount of water or large equipment.

The powder material supply portion 25 is connected to the defibrating portion 13 of the configuration of the sheet manufacturing apparatus 100 in the embodiment. The powder material supply portion 25 is a portion for supplying the powder material RM containing a first particle and a second particle having a different composition from that of the first particle to the fiber-containing material (defibrated material) M3 during defibrating. Therefore, the powder material RM supplied from the powder material supply portion 25 to the defibrating portion 13 is mixed with the fiber-containing material (defibrated material) M3 during defibrating. That is, in the embodiment, in the defibrating portion 13, the powder material supply step of supplying the powder material RM to the fiber-containing material M3, and the agitating step of agitating the powder material and the fiber-containing material in a state where the powder material RM and the fiber-containing material M3 are mixed are performed with the defibrating step. In a case where a shearing force acts between the powder material RM and the fiber-containing material (defibrated material) M3 and the foreign material CM adheres to the fiber-containing material (defibrated material) M3, the foreign material CM efficiently is removed. The configuration of the powder material supply portion 25 and the powder material RM are the same as these of the first embodiment.

In the embodiment, the powder material RM containing the first particle and the second particle is removed at once by the powder material removing portion 28, and the invention is not limited thereto. The first particle and the second particle of the powder material RM may be divided into a plurality of stages and removed. In this case, each removal may be performed by a method suitable for the particle composition of each of the first particle and the second particle. For example, the removal of the first particle, which is easier to charge than the second particle, may be performed by an electrostatic adsorption method or the like in a previous step or a subsequent step of the powder material removing portion 28. As a result, the removal rate of the powder material RM as a whole can be more efficiently increased.

The powder material RM contains the first particle and the second particle, and the first particle and the second particle have different compositions from each other.

By using such a powder material RM, it is possible to remove the foreign material CM contained in the fiber-containing material M3, and to improve the removal efficiency of the foreign material as a whole by a mechanism corresponding to each of the first particle and the second particle. In addition, the foreign material CM can be removed (deinked) from the fiber-containing material M3 with a high removal rate in short time processing. In addition, as compared with a case of using a single type of particles, it is possible to efficiently remove the foreign material CM while suppressing damage to the fiber-containing material M3 (for example, excessive cutting of fiber during deinking, or the like).

The powder material RM may contain at least one of the first particle and the second particle respectively, and normally, contains a plurality of first particles and a plurality of second particles.

The powder material RM can be suitably prepared by mixing the separately prepared first particles (in particular, first particle group including a plurality of first particles) and the second particles (in particular, second particle group including a plurality of second particles).

At least one of the first particle and the second particle may contain plural types of components. In a case where at least one of the first particle and the second particle contains plural types of components, even if components common to each other are contained, these particles have different compositions from each other as long as the contents of at least one of the plurality of types of components are different from each other.

Examples of the constituent material of the powder material RM (first particle and second particle) include a composite material of an inorganic material and an organic material, in addition to various inorganic materials and various organic materials.

Examples of the inorganic material forming the powder material RM include various metallic materials such as iron and stainless steel, metal compounds such as sodium chloride, aluminum sulfate, calcium carbonate, titanium oxide, alumina and the like (ionic substance, metal oxide, metal nitride, metal carbide, and the like), various types of glass, various ores such as talc, dry ice, and the like.

In particular, calcium carbonate is preferable as the inorganic material forming the powder material RM.

In a case where the foreign material CM is contained in the defibrated material M3 as the powder material RM contains calcium carbonate, the foreign material CM can be removed more efficiently. It is considered that such excellent effects can be obtained for the following reasons.

That is, in calcium carbonate, the fiber forming the defibrated material M3 has fine unevenness on the surface, and there is a problem that foreign material is likely to adhere to and remain in the recessed portion. Calcium carbonate has a feature that it is suitably crushed by impact during the deinking processing and easily comes into contact with the foreign material in the recessed portion. In addition, in a case of using calcium carbonate, a new surface having excellent adsorption ability is exposed by crushing during the deinking processing as described above, and thus it is possible to prevent or suppress a decrease in adsorption ability with time of the powder material RM during the deinking processing.

In a case where dry ice is used as the inorganic material forming the powder material RM, at least a portion of the dry ice normally sublimes during the deinking processing, and thus it is possible to reduce the amount of the powder material RM collected by the powder material removing portion 28.

Examples of the organic material forming the powder material RM include various resin materials such as various thermoplastic resins and various thermosetting resins, natural resin such as rosin, cellulose type materials such as cellulose, cellulose-modified materials (for example, methylcellulose, carboxymethylcellulose and salts thereof (for example, sodium salt and the like)), a material having a sugar chain structure such as starch, alginic acid, and chitosan, plant materials such as a crushed outer shell of the seed of the plant (seeds of walnut, peach, apricot, and the like), and a crushed actual shell of the plant fruit (dried corn grain, dried wheat endosperm, and the like), and various sizing agents such as rosin type sizing agent, alkyl ketene dimer type sizing agent, alkenyl succinic acid type anhydride type sizing agent.

Examples of thermoplastic resin include polyolefins such as polyethylene, polypropylene, ethylene-vinyl acetate copolymer, a liquid crystal polymer such as modified polyolefin, polyamide (example: nylon 6, nylon 46, nylon 66, nylon 610, nylon 612, nylon 11, nylon 12, nylon 6-12, nylon 6-66), thermoplastic polyimide, aromatic polyester, various thermoplastic elastomers such as polyphenylene oxide, polyphenylene sulfide, polycarbonate, polymethyl methacrylate, polyether, polyether ether ketone, polyether imide, polyacetal, styrene type, polyolefin type, polyvinyl chloride type, polyurethane type, polyester type, polyamide type, polybutadiene type, trans polyisoprene type, fluoro rubber type, chlorinated polyethylene type, or copolymers mainly containing these, blends, polymer alloys.

Examples of thermosetting resin include an epoxy resin, a phenol resin, a urea resin, a melamine resin, polyester (unsaturated polyester) resin, polyimide resin, silicone resin, polyurethane resin, and the like.

In addition, as the organic material forming the powder material RM, for example, a hydrophilic polymer used as a gel material such as polyacrylic acid salt (for example, sodium salt), polyacrylamide or the like may be used.

In particular, as the organic material forming the powder material RM, a substance having at least one of a hydroxyl group and a carboxyl group is preferable.

In a case where the foreign material CM is contained in the defibrated material M3 as the powder material RM contains the substance, the foreign material CM can be removed more efficiently. It is considered that such excellent effects can be obtained for the following reasons.

That is, in general, a recording material such as ink or toner used for a recording medium such as paper is designed so as to have excellent affinity and adhesion to cellulose fiber, which is the main material of the recording medium. On the other hand, the cellulose fiber contains a polymer material containing β-glucose having a large number of hydroxyl groups in the molecule as a constituent monomer, and is a highly hydrophilic material.

A substance having at least one of hydroxyl group and carboxyl group is also highly hydrophilic and exhibits polarity (hydrophilicity) similar to that of cellulose fiber.

Therefore, the substance having at least one of a hydroxyl group and a carboxyl group has a high affinity with the foreign material CM derived from a recording material such as ink and toner, and can effectively adsorb the foreign material CM in a case where the substance comes in contact with the defibrated material M3 containing the foreign material CM.

As a result, the foreign material CM contained in the defibrated material M3 can be more efficiently removed.

In addition, if the powder material RM contains the material, when the powder material RM is supplied so as to collide with the defibrated material M3, by the electrostatic interaction, collision between the foreign material CM contained in the defibrated material M3 and the powder material RM is likely to occur, and the removal efficiency of the foreign material CM contained in the defibrated material M3 can be made particularly excellent.

In addition, even in a case where the substance remains in the defibrated material M3 after the deinking processing, normally, adverse influence on the defibrated material M3 after the deinking processing and the sheet S manufactured using the same is sufficiently small. In addition, in some cases, it is possible to obtain an effect such that the sheet S to be manufactured can be made more excellent in paper strength, affinity to a recording material such as ink, toner, or the like.

The substance contains various compounds such as a polymeric material and a low-molecular material, and preferably has a sugar chain structure.

A compound having a sugar chain structure is normally a material having a high ratio of hydroxyl groups in the molecule (ratio of the number of hydroxyl groups to the molecular weight) and particularly high hydrophilicity. Therefore, it is particularly advantageous in improving the adsorption property of foreign material CM.

Examples of the polymeric material having a sugar chain structure include cellulose, a cellulose-modified material (for example, methylcellulose, carboxymethylcellulose or a salt thereof (for example, sodium salt and the like)), starch, alginic acid, chitosan, and the like. Among these, it is preferable to contain at least one of cellulose and a cellulose-modified material, and it is more preferable to contain a salt of carboxymethyl cellulose.

When the salt of carboxymethyl cellulose is used, the above-described effect is more remarkably exhibited. In addition, the salt of carboxymethyl cellulose has appropriate conductivity, it is unlikely to charge during deinking processing, and the effect of neutralizing is exhibited. As a result, it is possible to more effectively prevent occurrence of problems such as constituent particles of the powder material clinging to the fiber, and causing it difficult to separate from the fiber during the deinking processing.

The powder material RM may contain paper dust.

Hereinafter, the combination of the constituent material of the first particle and the constituent material of the second particle will be described.

In a case where both of the first particle and the second particle are formed of a material containing an organic material, the following effects can be obtained. That is, many organic materials have a feature that is easily charged by friction. Therefore, by using a plurality of types of organic materials in combination (using in combination as constituent material of first particle and constituent material of second particle), the foreign material CM contained in the fiber-containing material M3 can be effectively removed by electrical adsorption, and the removal efficiency of the foreign material CM as a whole can be further improved. In addition, the foreign material CM can be removed (deinked) from the fiber-containing material M3 with a high removal rate in short time processing.

In a case where both of the first particle and the second particle are formed of a material containing an organic material, for example, one of the first particles and the second particles may be formed of a material containing a salt of carboxymethyl cellulose and the other may be formed of a material containing a polyamide.

As a result, the function possessed by the salt of carboxymethyl cellulose as described above can be more effectively exhibited while exhibiting the superior charging property possessed by the polyamide. The frequency of contact and separation opportunities between the fiber forming the fiber-containing material M3 and the powder material RM increases, and the removal ability of the foreign material CM as a whole of the powder material RM can be made particularly excellent.

In addition, in a case where both of the first particle and the second particle are formed of a material containing an organic material, one of the first particle and the second particle may be formed of a material containing a salt of carboxymethyl cellulose and the other of the first particle and the second particle may be formed of a material containing polyacrylamide.

As a result, the function possessed by the salt of carboxymethyl cellulose as described above can be more effectively exhibited while exhibiting the superior charging property possessed by the polyamide. The frequency of contact and separation opportunities between the fiber forming the fiber-containing material M3 and the powder material RM increases, and the removal ability of the foreign material CM as a whole of the powder material RM can be made particularly excellent.

In addition, in a case where both of the first particle and the second particle are formed of a material containing an organic material, one of the first particle and the second particle may be formed of a material containing a salt of carboxymethyl cellulose, and the other may be formed of a material containing a polyacrylate (for example, sodium salt or the like).

Polyacrylate is normally a material with high crystallinity, and the solid is likely to form angular portions on the surface. Therefore, by using as a constituent material of the powder material RM, the removal efficiency of the foreign material CM from the fiber-containing material M3 can be made more excellent. On the other hand, in a case where a polyacrylic acid salt is used alone, the fiber forming the fiber-containing material M3 is likely to be damaged, and when used in combination with a salt of carboxymethyl cellulose, it is possible to sufficiently exhibit the effect of using the polyacrylic acid salt while appropriately protecting the fiber. As a result, the removal efficiency of the foreign materials CM from the fiber-containing material M3 can be made more excellent while suitably protecting the fiber forming the fiber-containing material M3 from damage in the deinking processing.

In addition, in a case where both of the first particle and the second particle are formed of a material containing an organic material, one of the first particle and the second particle may be formed of a material containing a salt of carboxymethyl cellulose, and the other may be formed of a material containing at least one of a salt of carboxymethyl cellulose having a molecular weight different from that of the carboxymethyl cellulose salt and a starch.

Amorphous carboxymethyl cellulose has a feature of deformability (elastic deformation) at the time of pressure application. Therefore, when colliding with the fiber, the foreign material CM entering the fiber recessed portion can be removed by deforming according to the unevenness shape of the fiber surface. However, by having deformability at the time of fiber collision, the time of adhesion to the fiber after collision increases and the fiber and particle can not be rapidly separated from each other. Therefore, by using a high molecular weight carboxymethyl cellulose salt or starch which is not easily elastically deformed for the first particle, the second particle is rapidly separated from the collided fiber and the opportunity of contact between the particle and the fiber can be increased. As a result, an effect of further improving the effect of removing the foreign materials CM on the fiber surface can be obtained.

In addition, in a case where both of the first particle and the second particle are formed of a material containing an inorganic material, the following effects can be obtained. That is, many inorganic materials have high specific gravity and high hardness. Therefore, it is possible to increase the collision energy at the time of collision with the fiber-containing material M3 in the deinking processing and to improve the removal efficiency of the foreign material CM from the fiber-containing material M3. In addition, the foreign material CM can be removed (deinked) from the fiber-containing material M3 with a high removal rate in short time processing.

In a case where both of the first particle and the second particle are formed of a material containing an inorganic material, for example, one of the first particles and the second particles may be formed of a material containing calcium carbonate and the other may be formed of a material containing titanium oxide.

As a result, the function possessed by the calcium carbonate as described above can be more effectively exhibited while exhibiting the characteristic of titanium oxide having high specific gravity and high hardness, and the removal ability of the foreign material CM as a whole of the powder material RM can be made particularly excellent.

In addition, in a case where both of the first particle and the second particle are formed of a material containing an inorganic material, for example, one of the first particles and the second particles may be formed of a material containing calcium carbonate and the other may be formed of a material containing alumina.

As a result, the function possessed by the calcium carbonate as described above can be more effectively exhibited while exhibiting the characteristic of alumina having high specific gravity and high hardness, and the removal ability of the foreign material CM as a whole of the powder material RM can be made particularly excellent.

In addition, in a case where both of the first particle and the second particle are formed of a material containing an inorganic material, for example, one of the first particles and the second particles may be formed of a material containing calcium carbonate and the other may be formed of a material containing talc.

Talc is a highly disintegratable mineral and produces a plurality of smaller diameter particles upon contact with the fiber. Therefore, when colliding with the fiber, it is possible to adsorb the foreign material CM entered the recessed portion on the fiber surface. However, fine particles entered the fiber recessed portion are unlikely to separate from the fiber due to van der Waals force or the like. Therefore, the calcium carbonate of the second particle collides with the fiber and pushes out the fine talc particles and foreign material CM entered the fiber recessed portion out of the fiber recessed portion. As a result, an effect of further improving the removal effect of foreign material CM on the fiber surface can be obtained.

In addition, in a case where one of the first particle and the second particle is formed of a material containing an organic material and the other is formed of a material containing an inorganic material, the following effects can be obtained. That is, in general, a feature possessed by the organic material that the organic material is likely to be charged by friction and can effectively remove the foreign material CM contained in the fiber-containing material M3 by electrical adsorption is exhibited. In general, a feature possessed by the inorganic material that the inorganic material has a high specific gravity and a high hardness, can increase the collision energy at the time of collision with the fiber-containing material M3 in the deinking processing, and can effectively remove the foreign materials CM from the fiber-containing material M3, is exhibited. Therefore, the effect of removing the foreign material CM as a whole of the powder material RM can be made more excellent.

In a case where one of the first particle and the second particle is formed of a material containing an organic material and the other is formed of a material containing an inorganic material, for example, one of the first particle and the second particle may be formed of a material containing a salt of carboxymethyl cellulose and the other may be formed of a material containing alumina.

Alumina is normally likely to form angular portions on the surface. Therefore, by using the alumina as a constituent material of the powder material RM, the removal efficiency of the foreign material CM from the fiber-containing material M3 can be made more excellent. On the other hand, in a case where alumina is used alone, the fiber forming the fiber-containing material M3 is likely to be damaged, and when used in combination with a salt of carboxymethyl cellulose, it is possible to sufficiently exhibit the effect of using the alumina while appropriately protecting the fiber. As a result, the removal efficiency of the foreign materials CM from the fiber-containing material M3 can be made more excellent while suitably protecting the fiber forming the fiber-containing material M3 from damage in the deinking processing.

In addition, in a case where one of the first particle and the second particle is formed of a material containing an organic material and the other is formed of a material containing an inorganic material, one of the first particle and the second particle may be formed of a material containing a salt of carboxymethyl cellulose and the other may be formed of a material containing calcium carbonate.

As a result, the effect of using the salt of carboxymethyl cellulose as described above and the effect of using calcium carbonate act synergistically, and the removal ability of foreign material CM as a whole powder material RM can be made particularly excellent.

It is preferable that the first particle and the second particle have different average particle diameters from each other.

As a result, while making removal efficiency of the foreign material CM adhering in a state of being exposed on the outer surface of the defibrated material M3 more excellent, the foreign material CM intruding a minute space such as a gap between the fibers forming the defibrated material M3 can be efficiently removed. As a result, the removal efficiency of foreign material CM from the defibrated material M3 can be made particularly excellent.

In the following description, it is assumed that the average particle diameter of the second particles is larger than the average particle diameter of the first particles.

The average particle diameter of the first particle group consisting of a plurality of first particles and the average particle diameter of the second particle group consisting of a plurality of second particles may be obtained from the particle size distribution of each particle group before mixing. The peak particle diameter on the small particle diameter side in the particle size distribution of the powder material RM may be the average particle diameter of the first particle group, and the peak particle diameter on the large particle diameter side in the particle size distribution of the powder material RM may be the average particle diameter of the second particle group (refer to FIG. 11).

In the specification, the average particle diameter refers to an average particle diameter based on the number unless otherwise specified. The average particle diameter of the powder refers to the number average value of the particle long diameter (diameter in the length direction of the particle) measured using a dry type particle size distribution meter and calculated by analysis using a static image analyzer (static image analysis apparatus: Morphologi G3: manufactured by Malvern).

The average particle diameter of the second particle group is preferably larger than the average particle diameter of the first particle group, and in particular, there is a preferable range for the degree of divergence between the particle diameters of both. That is, the average particle diameter of the second particle group is preferably two times or more and 10,000 times or less, more preferably 3 times or more and 1,000 times or less, and still more preferably 5 times or more and 100 times or less the average particle diameter of the first particle group.

As a result, the synergistic effect due to containing the first particle group and the second particle group is exhibited more remarkably. In addition, it is possible to effectively prevent from containing excessively minute particles, and to more effectively prevent unintended scattering (in particular, scattering which is difficult to recover) of the powder material RM during the deinking processing or the like.

The average particle diameter of the first particle group is preferably 0.01 μm or more and 10 μm or less, more preferably 0.05 μm or more and 7.0 μm or less, and still more preferably 0.1 μm or more and 5.0 μm or less.

As a result, the foreign material CM intruding a minute space such as a gap between the fibers forming the defibrated material M3 can be more efficiently removed, and the removal efficiency of the foreign material CM as a whole of the powder material RM can be made more excellent. In addition, it is possible to effectively prevent from containing excessively minute particles, and to more effectively prevent unintended scattering (in particular, scattering which is difficult to recover) of the powder material RM (in particular, first particle) during the deinking processing or the like.

The minimum particle diameter of the first particle group is preferably 0.01 μm or more and 3.0 μm or less, more preferably 0.02 μm or more and 2.5 μm or less, and still more preferably 0.03 μm or more and 2.0 μm or less.

As a result, the foreign material CM intruding a minute space such as a gap between the fibers forming the defibrated material M3 can be more efficiently removed, and the removal efficiency of the foreign material CM as a whole of the powder material RM can be made more excellent. In addition, it is possible to effectively prevent from containing excessively minute particles, and to more effectively prevent unintended scattering (in particular, scattering which is difficult to recover) of the powder material RM (in particular, first particle) during the deinking processing or the like.

The maximum particle diameter of the first particle group is preferably 0.1 μm or more and 100 μm or less, more preferably 0.2 μm or more and 70 μm or less, and still more preferably 0.3 μm or more and 50 μm or less.

As a result, the foreign material CM intruding a minute space such as a gap between the fibers forming the defibrated material M3 can be more efficiently removed, and the removal efficiency of the foreign material CM as a whole of the powder material RM can be made more excellent.

The average value of the aspect ratios of the first particles forming the first particle group is preferably 1.0 or more and 5.0 or less, more preferably 1.05 or more and 4.9 or less, and still more preferably 1.1 or more and 4.8 or less.

As a result, the foreign material CM intruding a minute space such as a gap between the fibers forming the defibrated material M3 can be more efficiently removed, and the removal efficiency of the foreign material CM as a whole of the powder material RM can be made more excellent.

The content rate of the first particles in the powder material RM is preferably from 10% by volume or more and 90% by volume or less, more preferably 20% by volume or more and 80% by volume or less, and still more preferably 30% by volume or more and 70% by volume or less.

As a result, the synergistic effect due to containing the first particle group and the second particle group that satisfy the relationship of the particle diameter as described above is exhibited more remarkably.

In addition, the average particle diameter of the second particle group is preferably 5 μm or more and 1500 μm or less, more preferably 7 μm or more and 1,400 μm or less, and still more preferably 10 μm or more and 1,200 μm or less.

As a result, the removal efficiency of the foreign material CM adhering in a state of being exposed on the outer surface of the defibrated material M3 can be made more excellent, and the removal efficiency of the foreign material CM as a whole of the powder material RM can be made more excellent.

The minimum particle diameter of the second particle group is preferably 0.5 μm or more and 1,000 μm or less, more preferably 0.7 μm or more and 850 μm or less, and still more preferably 1 μm or more and 800 μm or less.

As a result, the removal efficiency of the foreign material CM adhering in a state of being exposed on the outer surface of the defibrated material M3 can be made more excellent, and the removal efficiency of the foreign material CM as a whole of the powder material RM can be made more excellent.

The maximum particle diameter of the second particle group is preferably 5 μm or more and 3,000 μm or less, more preferably 10 μm or more and 2,000 μm or less, and still more preferably 15 μm or more and 1,500 μm or less.

As a result, the removal efficiency of the foreign material CM adhering in a state of being exposed on the outer surface of the defibrated material M3 can be made more excellent, and the removal efficiency of the foreign material CM as a whole of the powder material RM can be made more excellent.

The average value of the aspect ratios of the second particles forming the second particle group is preferably 1.0 or more and 50 or less, more preferably 1.05 or more and 30 or less, and still more preferably 1.1 or more and 20 or less.

As a result, the removal efficiency of the foreign material CM adhering in a state of being exposed on the outer surface of the defibrated material M3 can be made more excellent, and the removal efficiency of the foreign material CM as a whole of the powder material RM can be made more excellent.

When the average value of the aspect ratios of the first particles forming the first particle group is $A_1$ and the average value of the aspect ratios of the second particles forming the second particle group is $A_2$, it is preferable that the relationship of $0.1 \leq A_2/A_1 \leq 50$ be satisfied, it is more preferable that the relationship of $0.5 \leq A_2/A_1 \leq 30$ be satisfied, and it is still more preferable that the relationship of $0.8 \leq A_2/A_1 \leq 15$ be satisfied.

The synergistic effect due to containing the first particle group and the second particle group that satisfy the relationship of the particle diameter as described above is exhibited more remarkably.

The average particle diameter of the powder material RM as a whole is preferably 2.6 μm or more and 255 μm or less, more preferably 5.1 μm or more and 153 μm or less, and still more preferably 10.2 μm or more and 120 μm or less.

As a result, the removal efficiency of the foreign material CM as a whole of the powder material RM can be made more excellent. In addition, it is possible to effectively prevent from containing excessively minute particles, and to more effectively prevent unintended scattering (in particular, scattering which is difficult to recover) of the powder material RM during the deinking processing or the like.

In addition, the ratio (R/L) of the average particle diameter (R) of the powder material RM to the average length (L) of the particles forming the defibrated material M3 is preferably 0.001 or more and 10 or less, more preferably 0.003 or more and 9 or less, and still more preferably 0.005 or more and 8 or less.

As a result, in the deinking processing, the fiber forming the defibrated material M3 can be more effectively prevented from being damaged, and the removal efficiency of the foreign material CM as a whole of the powder material RM can be made more excellent.

The content rate of the second particles in the powder material RM is preferably from 10% by volume or more and 90% by volume or less, more preferably 20% by volume or more and 80% by volume or less, and still more preferably 30% by volume or more and 70% by volume or less.

As a result, the synergistic effect due to containing the first particle group and the second particle group that satisfy the relationship of the particle diameter as described above is exhibited more remarkably.

When the content ratio of the first particles in the powder material RM is $X_1$ (% by volume) and the content rate of the second particles in the powder material RM is $X_2$ (% by volume), it is preferable that the relationship of $0.01 \leq X_1/X_2 \leq 10.0$ be satisfied, it is more preferable that the relationship of $0.01 \leq X_1/X_2 \leq 5.0$ be satisfied, and it is still more preferable that the relationship of $0.15 \leq X_1/X_2 \leq 2.33$ be satisfied.

As a result, the synergistic effect due to containing the first particle group and the second particle group that satisfy the relationship of the particle diameter as described above is exhibited more remarkably.

For example, the first particle and the second particle may have the same density, and it is preferable that the first particle and the second particle have mutually different densities from each other.

As a result, the synergistic effect due to containing the first particle group and the second particle group is exhibited more remarkably.

In the specification, unless otherwise specified, density refers to true specific gravity.

In a case where the density of the first particle is different from the density of the second particle, the density of the first particle may be smaller than the density of the second particle, and is preferably greater than the density of the second particle.

As a result, in the deinking processing, the kinetic energy of the first particles (particles having a relatively small particle diameter) can be sufficiently increased, the deinking processing with the first particles (in particular, removal of foreign material CM intruding into a minute space such as a gap between fibers forming defibrated material M3) can be efficiently proceeded, and the kinetic energy of the second particles (particles having a relatively large particle diameter) can be more reliably prevented from being excessively increased. Accordingly, the fiber forming the defibrated material M3 can be more effectively prevented from being damaged (excessively shortening fiber length).

In particular, when the density of the first particles is $\rho_1$ [g/cm$^3$] and the density of the second particles is $\rho_2$ [g/cm$^3$], it is preferable that the relationship of $0.2 \leq \rho_1/\rho_2 \leq 15$ be satisfied, it is more preferable that the relationship of $0.3 \leq \rho_1/\rho_2 \leq 10$ be satisfied, and it is still more preferable that the relationship of $0.5 \leq \rho_1/\rho_2 \leq 5$ be satisfied.

As a result, in the deinking processing, the kinetic energy of the first particles (particles having a relatively small particle diameter) can be sufficiently increased, the deinking processing with the first particles (in particular, removal of foreign material CM intruding into a minute space such as a gap between fibers forming defibrated material M3) can be efficiently proceeded, and the kinetic energy of the second particles (particles having a relatively large particle diameter) can be more reliably prevented from being excessively increased. Accordingly, the fiber forming the defibrated material M3 can be more effectively prevented from being damaged (excessively shortening fiber length).

The density of the first particles is preferably 1.3 g/cm$^3$ or more and 10.0 g/cm$^3$ or less, more preferably 1.8 g/cm$^3$ or more and 8.0 g/cm$^3$ or less, and still more preferably 2.5 g/cm$^3$ or more and 5.0 g/cm$^3$ or less.

As a result, in the deinking processing, the kinetic energy of the first particles can be sufficiently increased, the deinking processing with the first particles (in particular, removal of foreign material CM intruding into a minute space such as a gap between fibers forming defibrated material M3) can be efficiently proceeded. Accordingly, the removal efficiency of the foreign material CM as a whole of the powder material RM can be made more excellent.

The density of the second particles is preferably 0.3 g/cm$^3$ or more and 8.0 g/cm$^3$ or less, more preferably 0.6 g/cm$^3$ or more and 6.2 g/cm$^3$ or less, and still more preferably 0.8 g/cm$^3$ or more and 4.8 g/cm$^3$ or less.

As a result, in the deinking processing, the kinetic energy of the second particles can be more reliably prevented from being excessively increased, the fiber forming the defibrated material M3 can be more effectively prevented from being damaged, and the removal efficiency of the foreign material CM as a whole of the powder material RM can be made more excellent.

The ratio ($\rho_P/\rho_F$) of the average value ($\rho_P$) of the density of the particles forming the powder material RM to the average value ($\rho_F$) of the density of the fiber forming the defibrated material M3 is 0.2 or more and 10 or less, more preferably 0.4 or more and 4.5 or less, and still more preferably 0.5 or more and 3.5 or less.

As a result, in the deinking processing, the defibrated material M3 and the powder material RM can be more suitably mixed, and the removal efficiency of the foreign material CM as a whole of the powder material RM can be made more excellent.

Examples

Next, specific examples of the invention will be described.

[1] Preparation of Powder Material (Deinking Agent)

Example 11

First, calcium carbonate powder having an average particle diameter of 5 μm, a minimum particle diameter of 1 μm, and a maximum particle diameter of 10 μm was prepared as a first particle group. The average value of the aspect ratios of the particles (first particles) forming the first particle group was 1.3.

On the other hand, a commercially available powdered carboxymethyl cellulose sodium salt (manufactured by Wako Pure Chemical Industries, Ltd.) was prepared.

The powdery sodium salt of carboxymethyl cellulose was subjected to classification processing using a classification device to obtain a plurality of fractions. Among these, a fraction having an average particle diameter of 120 μm, a minimum particle diameter of 25 μm, and a maximum particle diameter of 150 μm was defined as a second particle group. The average value of the aspect ratios of the particles (second particles) forming the second particle group was 15.

The first particle group and the second particle group as described above were mixed at a volume ratio of 1:9 to obtain a powder material (deinking agent) as a mixed powder.

Examples 12 to 38

A powder material (deinking agent) as a mixed powder was obtained in the same manner as in Example 11 except that the conditions (constituent materials, material particle size distribution) of the first particle group and the second particle group are set as shown in Tables 3 and 4, and the mixing ratio of the first particle group and the second particle group was changed as shown in Tables 3 and 4.

Regarding those containing the particle group containing particles formed of sodium salt of carboxymethyl cellulose (CMC-Na) of the powder material (deinking agent) according to each of the above examples, the CMC-Na had solubility at 25° C. in water of 3.0 g/100g$H_2O$ or more and 50 g/100g$H_2O$ less, or the contact angle of water was 45° or less in any case.

Comparative Example 3

A powder material (deinking agent) was obtained in the same manner as in Example 11 except that the fraction having an average particle diameter of 120 μm, a minimum particle diameter of 25 μm, and a maximum particle diameter of 150 μm was used as it was as a powder material (deinking agent) among the powders of sodium salt of carboxymethyl cellulose fractionated in the same manner as in Example 11.

Comparative Examples 4 and 5

A powder material (deinking agent) was obtained in the same manner as in Comparative Example 3 except that the conditions of the particles forming the powder material were changed as shown in Table 4.

The conditions of the powder materials (deinking agent) according to each example and each comparative example are summarizes in Tables 3 and 4. In the table, the sodium salt of carboxymethyl cellulose is indicated as "CMC-Na". In addition, in each of the sodium salts of carboxymethyl cellulose not showing the molecular weight in the table, the weight average molecular weight was approximately 3,000.

TABLE 3

| | First particle | | | | | | | |
|---|---|---|---|---|---|---|---|---|
| | Constituent material | Average particle diameter [μm] | Minimum particle diameter [μm] | Maximum particle diameter [μm] | Aspect ratios | Density [g/cm$^3$] | Content [% by mass] | Second particle Constituent material |
| Example 11 | $CaCO_3$ | 5 | 1 | 10 | 1.3 | 2.93 | 10.1 | CMC-Na |
| Example 12 | $TiO_2$ | 0.21 | 0.1 | 0.3 | 1.1 | 4.3 | 11.1 | CMC-Na |
| Example 13 | Talc | 5 | 2 | 50 | 1.1 | 2.7 | 19.0 | CMC-Na |
| Example 14 | Alumina | 5 | 4.5 | 5.3 | 1.2 | 3.54 | 3.4 | CMC-Na |
| Example 15 | $CaCO_3$ | 5 | 1 | 10 | 1.3 | 2.93 | 9.3 | Polyamide |
| Example 16 | $CaCO_3$ | 5 | 1 | 10 | 1.3 | 2.93 | 10.9 | Starch |
| Example 17 | $CaCO_3$ | 5 | 1 | 10 | 1.3 | 2.93 | 9.3 | Polyacrylic acid Na |
| Example 18 | $CaCO_3$ | 5 | 1 | 10 | 1.3 | 2.93 | 9.3 | Polyacrylamide |
| Example 19 | Alumina | 5 | 4.5 | 5.3 | 1.2 | 3.54 | 10.0 | Polyamide |
| Example 20 | Alumina | 5 | 4.5 | 5.3 | 1.2 | 3.54 | 11.8 | Starch |
| Example 21 | Alumina | 5 | 4.5 | 5.3 | 1.2 | 3.54 | 10.0 | Polyacrylic acid Na |
| Example 22 | Alumina | 5 | 4.5 | 5.3 | 1.2 | 3.54 | 10.0 | Polyacrylamide |
| Example 23 | $TiO_2$ | 0.21 | 0.1 | 0.3 | 1.1 | 4.3 | 11.1 | CMC-Na |
| Example 24 | $TiO_2$ | 0.21 | 0.1 | 0.3 | 1.1 | 4.3 | 10.2 | Polyamide |
| Example 25 | $TiO_2$ | 0.21 | 0.1 | 0.3 | 1.1 | 4.3 | 12.0 | Starch |
| Example 26 | $TiO_2$ | 0.21 | 0.1 | 0.3 | 1.1 | 4.3 | 10.2 | Polyacrylic acid Na |
| Example 27 | $TiO_2$ | 0.21 | 0.1 | 0.3 | 1.1 | 4.3 | 10.2 | Polyacrylamide |

| | Second particle | | | | | | |
|---|---|---|---|---|---|---|---|
| | Average particle diameter [μm] | Minimum particle diameter [μm] | Maximum particle diameter [μm] | Aspect ratios | Density [g/cm$^3$] | Content [% by mass] | Average particle diameter as a whole of powder material [μm] |
| Example 11 | 120 | 25 | 150 | 15 | 1.6 | 89.9 | 108.4 |
| Example 12 | 120 | 25 | 150 | 15 | 1.6 | 88.9 | 106.7 |
| Example 13 | 120 | 25 | 150 | 15 | 1.6 | 81.0 | 98.1 |
| Example 14 | 120 | 25 | 150 | 15 | 1.6 | 96.6 | 116.1 |
| Example 15 | 10 | 5 | 15 | 1.1 | 1.14 | 90.7 | 9.5 |
| Example 16 | 30 | 10 | 100 | 1.5 | 1.4 | 89.1 | 27.3 |
| Example 17 | 100 | 30 | 250 | 1.7 | 1.2 | 90.7 | 91.2 |
| Example 18 | 50 | 30 | 250 | 1.7 | 1.19 | 90.7 | 45.8 |
| Example 19 | 10 | 5 | 15 | 1.1 | 1.14 | 90.0 | 9.5 |
| Example 20 | 30 | 10 | 100 | 1.5 | 1.4 | 88.2 | 27.1 |
| Example 21 | 100 | 30 | 250 | 1.7 | 1.2 | 90.0 | 90.5 |
| Example 22 | 50 | 30 | 250 | 1.7 | 1.19 | 90.0 | 45.5 |
| Example 23 | 120 | 25 | 150 | 15 | 1.6 | 88.9 | 106.7 |

TABLE 3-continued

| | | | | | | | |
|---|---|---|---|---|---|---|---|
| Example 24 | 10 | 5 | 15 | 1.1 | 1.14 | 89.8 | 9.0 |
| Example 25 | 30 | 10 | 100 | 1.5 | 1.4 | 88.0 | 26.4 |
| Example 26 | 100 | 30 | 250 | 1.7 | 1.2 | 89.8 | 89.8 |
| Example 27 | 50 | 30 | 250 | 1.7 | 1.19 | 89.8 | 44.9 |

TABLE 4

| | First particle | | | | | | | |
|---|---|---|---|---|---|---|---|---|
| | Constituent material | Average particle diameter [μm] | Minimum particle diameter [μm] | Maximum particle diameter [μm] | Aspect ratios | Density [g/cm$^3$] | Content [% by mass] | Second particle Constituent material |
| Example 28 | CMC-Na (Mw8000) | 120 | 25 | 150 | 15 | 1.6 | 10.9 | CMC-Na (Mw3000) |
| Example 29 | Polyamide | 1 | 0.5 | 2 | 1.2 | 1.14 | 10.9 | CMC-Na |
| Example 30 | Polyester | 1.2 | 0.5 | 3 | 1.3 | 1.38 | 10.9 | CMC-Na |
| Example 31 | Starch | 3 | 1 | 10 | 1.5 | 1.4 | 9.2 | CMC-Na |
| Example 32 | Polyacrylic acid Na | 5 | 3 | 25 | 1.7 | 1.2 | 10.9 | CMC-Na |
| Example 33 | Methylcellulose | 5 | 2 | 20 | 12 | 1.6 | 10.9 | CMC-Na |
| Example 34 | Rosin | 5 | 2 | 50 | 4 | 1.08 | 10.9 | CMC-Na |
| Example 35 | Polyacrylamide | 3 | 1 | 20 | 1.2 | 1.19 | 10.9 | CMC-Na |
| Example 36 | $TiO_2$ | 0.21 | 0.1 | 0.3 | 1.1 | 4.3 | 11.0 | $CaCO_3$ |
| Example 37 | Talc | 5 | 2 | 50 | 1.1 | 2.7 | 18.9 | $CaCO_3$ |
| Example 38 | Alumina | 5 | 4.5 | 5.3 | 1.2 | 3.54 | 3.3 | $CaCO_3$ |
| Comparative Example 3 | CMC-Na | 120 | 25 | 150 | 15 | 1.6 | 100 | — |
| Comparative Example 4 | $CaCO_3$ | 5 | 1 | 10 | 1.3 | 2.93 | 100 | — |
| Comparative Example 5 | $TiO_2$ | 0.21 | 0.1 | 0.3 | 1.1 | 4.3 | 100 | — |

| | Second particle | | | | | | |
|---|---|---|---|---|---|---|---|
| | Average particle diameter [μm] | Minimum particle diameter [μm] | Maximum particle diameter [μm] | Aspect ratios | Density [g/cm$^3$] | Content [% by mass] | Average particle diameter as a whole of powder material [μm] |
| Example 28 | 120 | 25 | 150 | 15 | 1.6 | 89.1 | 120 |
| Example 29 | 120 | 25 | 150 | 15 | 1.6 | 89.1 | 107.0 |
| Example 30 | 120 | 25 | 150 | 15 | 1.6 | 89.1 | 107.1 |
| Example 31 | 120 | 25 | 150 | 15 | 1.6 | 90.8 | 109.2 |
| Example 32 | 120 | 25 | 150 | 15 | 1.6 | 89.1 | 107.5 |
| Example 33 | 120 | 25 | 150 | 15 | 1.6 | 89.1 | 107.5 |
| Example 34 | 120 | 25 | 150 | 15 | 1.6 | 89.1 | 107.5 |
| Example 35 | 120 | 25 | 150 | 15 | 1.6 | 89.1 | 107.3 |
| Example 36 | 5 | 1 | 10 | 1.3 | 2.93 | 89.0 | 4.5 |
| Example 37 | 20 | 5 | 45 | 1.3 | 2.93 | 81.1 | 17.2 |
| Example 38 | 10 | 1 | 20 | 1.3 | 2.93 | 96.7 | 9.8 |
| Comparative Example 3 | — | — | — | — | — | — | 120 |
| Comparative Example 4 | — | — | — | — | — | — | 5 |
| Comparative Example 5 | — | — | — | — | — | — | 0.21 |

[2] Deinking Processing and Manufacture of Sheet

Using the powder materials (deinking agent) prepared in each of the above Examples and Comparative Examples, the following processing (deinking processing) and manufacture of a sheet were performed.

First, the sheet manufacturing apparatus having the configuration shown in FIG. 1 was prepared, and commercially available copy paper was subjected to monochrome printing of 10% duty on one side with an ink jet printer (PX-M7050FT manufactured by Seiko Epson Corporation) was prepared as a raw material. The mesh opening of the mesh belt (mesh body) included in the first web forming portion of the powder material removing portion of the sheet manufacturing apparatus was 600 μm.

Next, the above raw material was supplied to the raw material supply portion of the sheet manufacturing apparatus, the sheet manufacturing apparatus was operated, and the raw material was subjected to processing such as crushing, defibrating, deinking and the like to produce a sheet.

At this time, the supply amount of the powder material (deinking agent) to 100 parts by mass of the fiber-containing material (defibrated material) was 100 parts by mass. The manufacturing conditions of the sheets were the same in each of the examples and the comparative examples except that the type of the powder material (deinking agent) was changed.

In each of the above embodiments, the ratio (R/L) of the average particle diameter (R) of the powder material as a whole to the average length (L) of the fiber forming the defibrated material to be subjected to the deinking processing was 0.001 or more and 10 or less in any case. In addition, in each of the above examples, the ratio ($\rho_P/\rho_F$) of the average value ($\rho_P$) of the density of the particles forming the powder material to the average value ($\rho_F$) of the density of the fiber forming the defibrated material to be subjected to the deinking processing was 0.2 or more and 10 or less in any case.

[3] Evaluation

[3-1] Coloring of Defibrated Material after Deinking Processing (Remaining Foreign Material)

For each of the examples and each of the comparative examples, a portion of the first web formed in the first web forming portion was taken out and observed with a digital microscope (VHX-5000 manufactured by Keyence Corporation). Compared with the state of the first web in a case where the processing was performed in the same manner as above except that the powder material (deinking agent) was not used, the remaining state of the foreign material derived from the recording material (ink) was evaluated according to the following criteria.

A: No remaining foreign material is observed.

B: Almost no remaining foreign material is observed.

C: Remaining foreign material is slightly observed.

D: Remaining foreign material is observed.

E: Remaining foreign material is significantly observed.

These results are summarized in Tables 5 and 6.

TABLE 5

| | Remaining foreign material |
|---|---|
| Example 11 | B |
| Example 12 | C |
| Example 13 | C |
| Example 14 | B |
| Example 15 | C |
| Example 16 | C |
| Example 17 | C |
| Example 18 | C |
| Example 19 | B |
| Example 20 | B |
| Example 21 | B |
| Example 22 | B |
| Example 23 | B |
| Example 24 | C |
| Example 25 | C |
| Example 26 | C |
| Example 27 | C |

TABLE 6

| | Remaining foreign material |
|---|---|
| Example 28 | B |
| Example 29 | A |
| Example 30 | C |
| Example 31 | B |
| Example 32 | B |
| Example 33 | C |
| Example 34 | C |
| Example 35 | A |
| Example 36 | B |
| Example 37 | B |
| Example 38 | B |
| Comparative Example 3 | E |
| Comparative Example 4 | E |
| Comparative Example 5 | E |

As is apparent from Tables 5 and 6, excellent results were obtained in the invention. That is, in the invention, the powder material (deinking agent) efficiently removed the foreign material contained in the defibrated material. In addition, in the invention, the whiteness of the manufactured sheet was excellent, and unintended coloring or unintended color unevenness due to remaining foreign material was not observed. In addition, in the invention, separability between the defibrated material subjected to the deinking treatment and the powder material (deinking agent) was also excellent. In each of the above examples, the removal rate of the powder material in the powder material removing portion was 90% or more in any case, and the removal rate of the second particle was higher than the removal rate of the first particle.

On the contrary, satisfactory results were not obtained in the comparative example.

In addition, deinking processing and sheet manufacture were performed in the same manner as described above except that the supply amount of the powder material (deinking agent) to 100 parts by mass of the defibrated material was variously changed in the range of 10 parts by mass or more and 100,000 parts by mass or less, and the same evaluation as above was performed, and the same results as described above were obtained.

In addition, the deinking processing and the sheet manufacture were performed in the same manner as described above except the apparatus used for the deinking processing and the sheet manufacture was changed to the one having the construction shown in FIG. 5, the one having the construction shown in FIG. 7, and the one shown in FIG. 9.

The entire disclosure of Japanese Patent Applications No. 2017-254973, filed Dec. 28, 2017, and No. 2018-032223, filed Feb. 26, 2018, are expressly incorporated by reference herein.

What is claimed is:

1. A processing method comprising:

supplying a powder material containing a first particle group consisting of a plurality of first particles, and a second particle group consisting of a plurality of second particles and having an average particle diameter larger than that of the first particle group, to a fiber-containing material containing a fiber during defibrating;

agitating the powder material and the fiber-containing material in a dry manner where the powder material and the fiber-containing material are mixed in air; and removing at least a portion of the powder material from the fiber-containing material supplied with the powder material, wherein the fiber-containing material contains a foreign material, the step of agitating the powder material and the fiber-containing material includes adsorbing the foreign material to the powder material, and the step of removing at least the portion of the powder material includes removing the foreign material adsorbed to the portion of the powder material.

2. A sheet manufacturing method comprising:

supplying a powder material containing a first particle group consisting of a plurality of first particles, and a second particle group consisting of a plurality of second particles and having an average particle diameter larger than that of the first particle group, to a fiber-containing material containing a fiber during defibrating;

agitating the powder material and the fiber-containing material in a dry manner where the powder material and the fiber-containing material are mixed in air; and removing at least a portion of the powder material from the fiber-containing material supplied with the powder material, wherein a sheet is manufactured from the fiber-containing material from which the powder material is removed, and wherein the fiber-containing material contains a foreign material, the step of agitating the powder material and the fiber-containing material includes adsorbing the foreign material to the powder material, and the step of removing at least the portion of the powder material includes removing the foreign material adsorbed to the portion of the powder material.

3. A processing method comprising:

supplying a powder material containing a first particle and a second particle having a different composition from that of the first particle, to the fiber-containing material containing a fiber during defibrating;

agitating the powder material and the fiber-containing material in a dry manner where the powder material and the fiber-containing material are mixed in air; and removing at least a portion of the powder material from the fiber-containing material supplied with the powder material, wherein the fiber-containing material contains a foreign material, the step of agitating the powder material and the fiber-containing material includes adsorbing the foreign material to the powder material, and the step of removing at least the portion of the powder material includes removing the foreign material adsorbed to the portion of the powder material.

4. A sheet manufacturing method comprising:

supplying a powder material containing a first particle and a second particle having a different composition from that of the first particle, to a fiber-containing material containing a fiber during defibrating;

agitating the powder material and the fiber-containing material in a dry manner where the powder material and the fiber-containing material are mixed in air; and removing at least a portion of the powder material from the fiber-containing material supplied with the powder material, wherein a sheet is manufactured from the fiber-containing material from which the powder material is removed, and wherein the fiber-containing material contains a foreign material, the step of agitating the powder material and the fiber-containing material includes adsorbing the foreign material to the powder material, and the step of removing at least the portion of the powder material includes removing the foreign material adsorbed to the portion of the powder material.

* * * * *